US006781487B2

(12) United States Patent
Hattori et al.

(10) Patent No.: US 6,781,487 B2
(45) Date of Patent: Aug. 24, 2004

(54) MULTIMODE DIELECTRIC RESONATOR DEVICE, DIELECTRIC FILTER, COMPOSITE DIELECTRIC FILTER, SYNTHESIZER, DISTRIBUTOR, AND COMMUNICATION DEVICE

(75) Inventors: Jun Hattori, Takatsuki (JP); Norihiro Tanaka, Nagaokakyo (JP); Shin Abe, Muko (JP); Toru Kurisu, Omihachiman (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 10/230,820

(22) Filed: Aug. 28, 2002

(65) Prior Publication Data

US 2003/0006864 A1 Jan. 9, 2003

Related U.S. Application Data

(62) Division of application No. 09/486,870, filed on May 31, 2000, now Pat. No. 6,496,087.

(30) Foreign Application Priority Data

Sep. 4, 1997 (JP) ..... 9-239685
Aug. 4, 1998 (JP) ..... 10-220371

(51) Int. Cl.[7] ..... H01P 7/10
(52) U.S. Cl. ..... 333/219.1; 333/202
(58) Field of Search ..... 333/219.1, 202

(56) References Cited

U.S. PATENT DOCUMENTS

| | | | | |
|---|---|---|---|---|
| 4,623,857 A | | 11/1986 | Nishikawa et al. | 333/219 |
| 5,233,319 A | * | 8/1993 | Mizan et al. | 333/219.1 |
| 5,568,101 A | | 10/1996 | Konishi et al. | 333/134 |
| 5,642,085 A | * | 6/1997 | Abe et al. | 333/219.1 |
| 5,764,115 A | | 6/1998 | Hattori et al. | 333/202 |
| 5,783,979 A | * | 7/1998 | Andoh et al. | 333/202 |

FOREIGN PATENT DOCUMENTS

| | | | |
|---|---|---|---|
| JP | 2-21907 | | 2/1990 |
| JP | 407058516 A | * | 3/1995 |
| JP | 09148810 A | * | 6/1997 |

OTHER PUBLICATIONS

Japanese Examination Report dispatched Jan. 28, 2003 (w/ English translation).
Japanese Office Action dated Jun. 17, 2003.

* cited by examiner

*Primary Examiner*—Stephen E. Jones
(74) *Attorney, Agent, or Firm*—Dickstein, Shapiro, Morin & Oshinsky, LLP.

(57) ABSTRACT

A dielectric resonator device comprising resonators small in size, having plural stages, and a dielectric resonator device with a high Qo, in a multimode are provided. A substantially parallelepiped-shaped dielectric core to resonate in plural modes such as TM01δ-x, -y, -z, TE01δ-x, -y, -z, and so forth is disposed in the center of a substantially parallelepiped-shaped cavity. These plural resonance modes are utilized.

4 Claims, 29 Drawing Sheets

(TM01 δ)

(TE01 δ)

MULTIMODE DIELECTRIC RESONATOR DEVICE, DIELECTRIC FILTER, COMPOSITE DIELECTRIC FILTER, SYNTHESIZER, DISTRIBUTOR, AND COMMUNICATION DEVICE

This is a divisional of U.S. patent application Ser. No. 09/486,870, filed May 31, 2000 in the name of Jun HATTORI, Norihiro TANAKA, Shin ABE, and Toru KURISU, entitled MULTIMODE DIELECTRI RESONATOR DEVICE, DIELECTRIC FILTER, COMPOSITE DIELECTRIC FILTER, SYNTHESIZER, DISTRIBUTOR, AND COMMUNICATION DEVICE, now U.S. Pat. No. 6,496,087.

TECHNICAL FIELD

The present invention relate to an electronic component, and more particularly to a dielectric resonator device, a dielectric filter, a composite dielectric filter, a synthesizer, a distributor, and a communication device including the same, each of which operates in a multimode

BACKGROUND ART

A dielectric resonator in which an electromagnetic wave in a dielectric is repeatedly totally-reflected from the boundary between the dielectric and air to be returned to its original position in phase, whereby resonance occurs is used as a resonator small in size, having a high unloaded Q ($Q_0$). As the mode of the dielectric resonator, a TE mode and a TM mode are known, which are obtained when a dielectric rod with a circular or rectangular cross section is cut to a length of $s \cdot \lambda g/2$ ($\lambda g$ represents a guide wavelength, and s is an integer) of the TE mode or the TM mode propagating in the dielectric rod. When the mode of the cross section is a TM 01 mode and the above-described s is equal to 1, a TM01δ mode resonator is obtained. When the mode of the cross section is a TE01 mode and s is equal to 1, a TE01δ mode dielectric resonator is obtained.

In these dielectric resonators, a columnar TM01δ mode dielectric core or a TE01δ mode dielectric core are disposed in a circular waveguide or rectangular waveguide as a cavity which interrupts the resonance frequency of the dielectric resonator, as shown in FIG. 26.

FIG. 27 illustrates the electromagnetic field distributions in the above-described two mode dielectric resonators. Hereupon, a continuous line represents an electric field, and a broken line a magnetic field, respectively.

In the case where a dielectric resonator device having plural stages is formed of dielectric resonators including such dielectric cores, the plural dielectric cores are arranged in a cavity. In the example shown in FIG. 26, the TM01δ mode dielectric cores of (A) are arranged in the axial direction, or the TE01δ mode dielectric cores of (B) are arranged in the same plane.

However, in such a conventional dielectric resonator device, to provide resonators in multi-stages, it is needed to position and fix plural dielectric cores at a high accuracy. Accordingly, there has been the problem that it is difficult to obtain dielectric resonator devices having even characteristics.

Further, conventionally, TM mode dielectric resonators each having a columnar or cross-shaped dielectric core integrally formed in a cavity have been used. In a dielectric resonator device of this type, the TM modes can be multiplexed in a definite space, and therefore, a miniature, multistage dielectric resonator device can be obtained. However, the concentration of an electromagnetic field energy to the magnetic core is low, and a real current flows through a conductor film formed on the cavity. Accordingly, there have been the problem that generally, a high Qo comparable to that of the TE mode dielectric resonator can not be attained.

DISCLOSURE OF INVENTION

It is an object of the present invention to provide a dielectric resonator device comprising resonators small in size, having plural stages, and to provide a multimode dielectric resonator device having a high Qo.

Moreover, it is another object of the present invention to provide a dielectric filter, a composite dielectric filter, a synthesizer, a distributor, and a communication device, each including the above-described multimode dielectric resonator.

In the multimode dielectric resonator device of the present invention, a dielectric core having a substantial parallelepiped-shape is arranged substantially in the center of a cavity having a substantial parallelepiped-shape, and a TM01δ-x mode where a magnetic field is rotated in a plane parallel to the y–z plane of x, y, z rectangular coordinates, and a TM01δ-y mode where a magnetic field is rotated in a plane parallel to the x–z plane are produced. Further, a TM01δ-x mode where a magnetic field is rotated in a plane parallel to the y–z plane, and a TM01δ-y mode where a magnetic field is rotated in a plane parallel to the x–z plane, and a TM01δ-z mode where a magnetic field is rotated in a plane parallel to the x–y plane are produced. As described above, since the dielectric core having a substantial parallelepiped-shape is disposed substantially in the center of the cavity having a substantial parallelepiped-shape, the concentration degree of an electromagnetic energy onto the dielectric core is enhanced, and a real electric current flowing through the cavity becomes fine. Accordingly, the Qo can be enhanced. Moreover, though the dielectric core and the cavity are single, respectively, two or three TM modes can be utilized, and the miniaturization as a whole can be realized.

In the multimode dielectric resonator device, a dielectric core having a substantial parallelepiped-shape is arranged substantially in the center of a cavity having a substantial parallelepiped-shape, a TM01δ-x mode where an electric field is rotated in a plane parallel to the y–z plane of x, y, z rectangular coordinates, and a TM01δ-y mode where an electric field is rotated in a plane parallel to the x–z plane are produced. Further, a TM01δ-x mode where an electric field is rotated in a plane parallel to the y–z plane of x, y, z rectangular coordinates, a TM01δ-y mode where an electric field is rotated in a plane parallel to the x–z plane, and a TM01δ-z mode where an electric field is rotated in a plane parallel to the x–z plane are produced. Like this, though the mode is a TE mode, multiplexing, that is, duplexing or triplexing can be realized, and the miniaturization as a whole can be performed.

In the multimode dielectric resonator device of this invention, the above-described duplex or triplex TM mode and the duplex or triplex TE mode are produced by means of the dielectric core and the cavity which are single, respectively. Accordingly, a dielectric resonator device employing a TM mode and a TE mode can be obtained. Further, the dielectric resonator device, since it has a multimode, that is, at least quadruplex mode, can be further miniaturized as a whole.

In the multimode dielectric resonator device of this invention, the resonator is rendered a multistage by coupling predetermined modes of the respective modes of the dielectric resonator device. Thereby, a resonator device is formed in which plural dielectric resonators are connected in a multistage. For example, a dielectric resonator device having a band-pass type filter characteristic can be obtained. Further, by coupling some of the plural resonance modes sequentially, and setting the other resonance modes to be independent, a filter in which a band-pass filter and a band rejection filter are combined can be formed.

According to the present invention, a dielectric filter is formed by providing an externally coupling means for externally coupling a predetermined mode of the dielectric resonator device.

According to the present invention, formed is a composite dielectric filter including a plurality of the dielectric filters and having at least three ports.

According to the present invention, a synthesizer comprises externally coupling means for externally coupling to plural predetermined modes of the dielectric resonator device, respectively, independently, and commonly externally coupling means for externally coupling to plural predetermined modes of the multimode dielectric resonator device in common, wherein the commonly externally coupling means is an output port, and the plural independently externally coupling means are input ports.

According to the present invention, a distributor comprises independently, externally coupling means for externally coupling to plural predetermined modes of the dielectric resonator device, respectively, independently, and commonly externally coupling means for externally coupling to plural predetermined modes of the dielectric resonator device in common, wherein the commonly externally coupling means is an input port, and the plural independently externally coupling means are output ports.

Moreover, according to the present invention, a communication device is formed of the above composite dielectric filter, a synthesizer, and a distributor provided in a high frequency section thereof.

BEST MODE FOR CARRYING OUT THE INVENTION

The configuration of a multimode dielectric resonator device according to a first embodiment will be described with reference to FIGS. 1 to 4.

Figure 1:
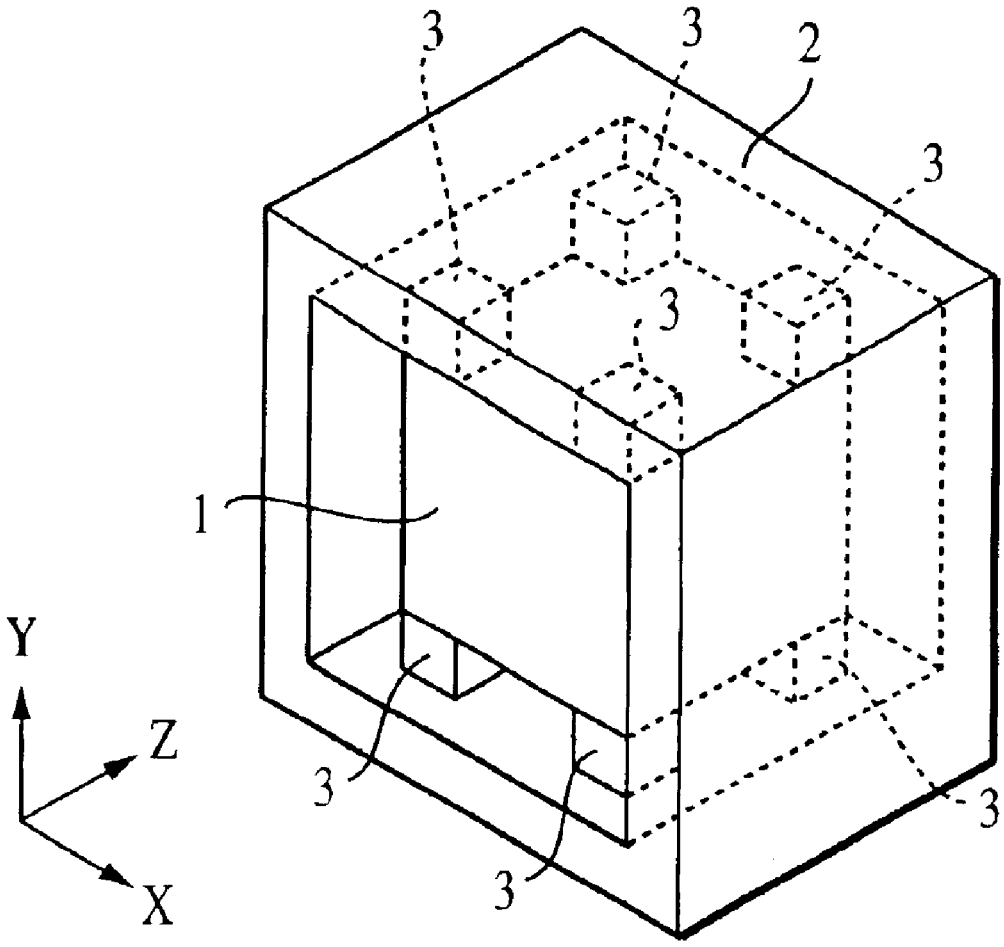
FIG. 1 is a perspective view showing the basic portion of a multimode dielectric resonator device according to a first embodiment.

FIG. 1 is a perspective view showing the basic constitution portion of the multimode dielectric resonator device. In this figure, reference numerals 1, 2, and 3 designate a substantially parallelepiped-shaped dielectric core, an angular pipe-shaped cavity, and supports for supporting the dielectric core 1 substantially in the center of the cavity 2. A conductor film is formed on the outer peripheral surface of the cavity 2. On the two open-faces, dielectric plates or metal plates each having a conductor film formed thereon are disposed, respectively, so that a substantially parallelepiped-shaped shield space is formed. In addition, an open-face of the cavity 2 is opposed to an open-face of another cavity so that the electromagnetic fields in predetermined resonance modes are coupled to provide a multistage.

Ordinarily, the supports 3 shown in FIG. 1, made of a ceramic material having a lower dielectric constant than the dielectric core 1 are disposed between the dielectric core 1 and the inner walls of the cavity 2 and fired to be integrated.

Figure 2A:
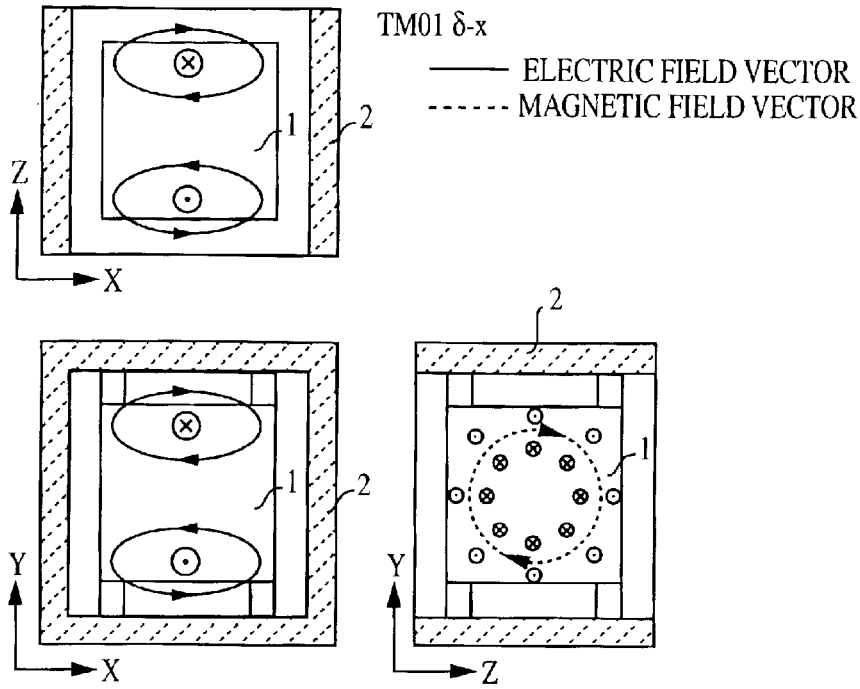
FIGS. 2(A,B) consists of cross sections showing the electromagnetic field distributions in the respective modes of the above resonator device.
Figure 2B:
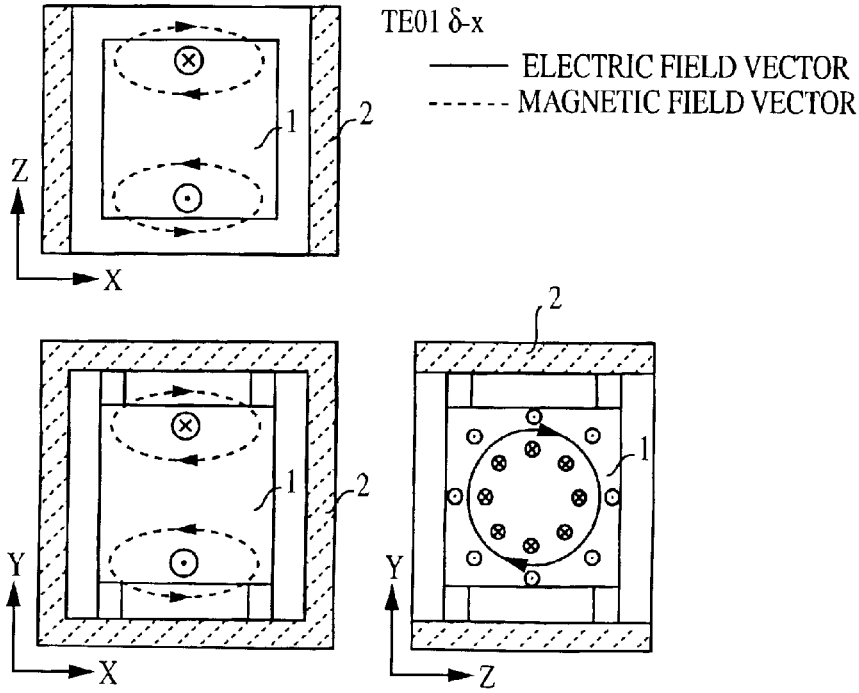
Figure 3A:
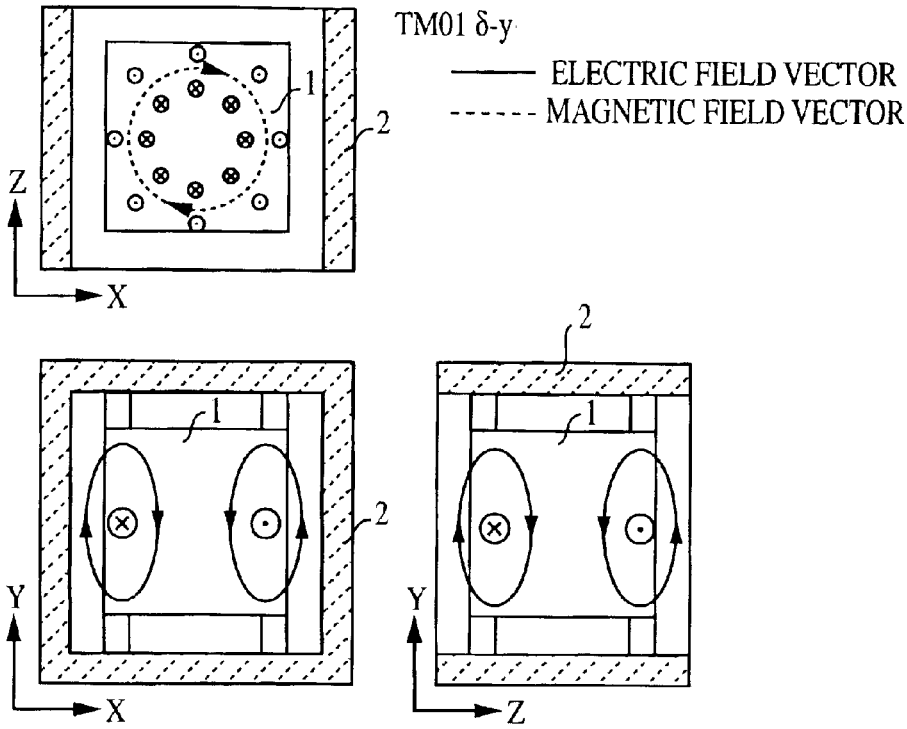
FIGS. 3(A,B) consists of cross sections showing the electromagnetic field distributions in the respective modes of the above resonator.
Figure 3B:
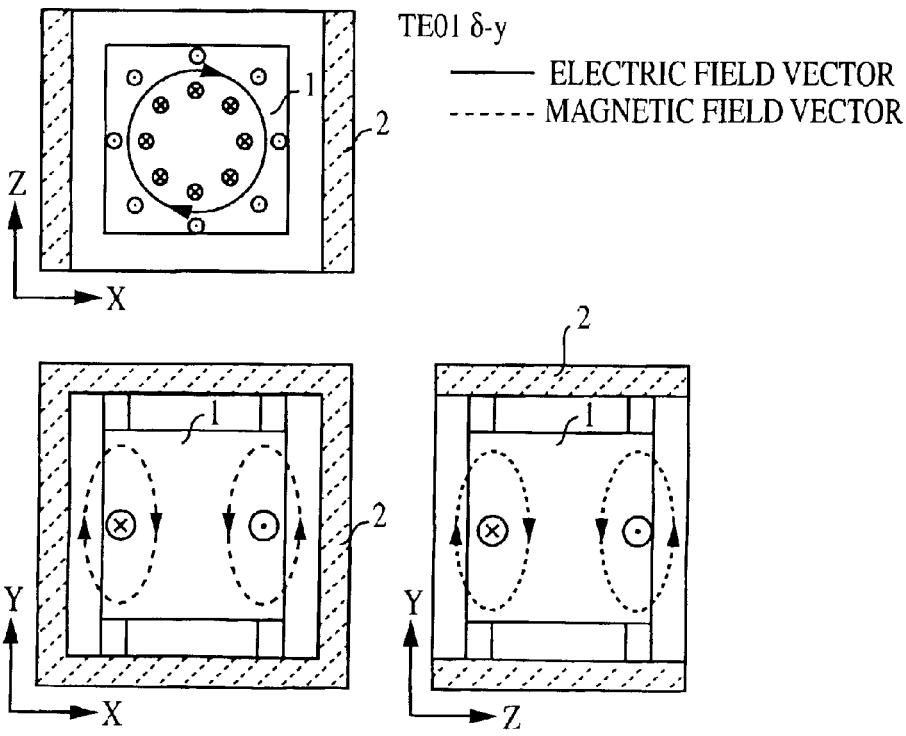
Figure 4A:
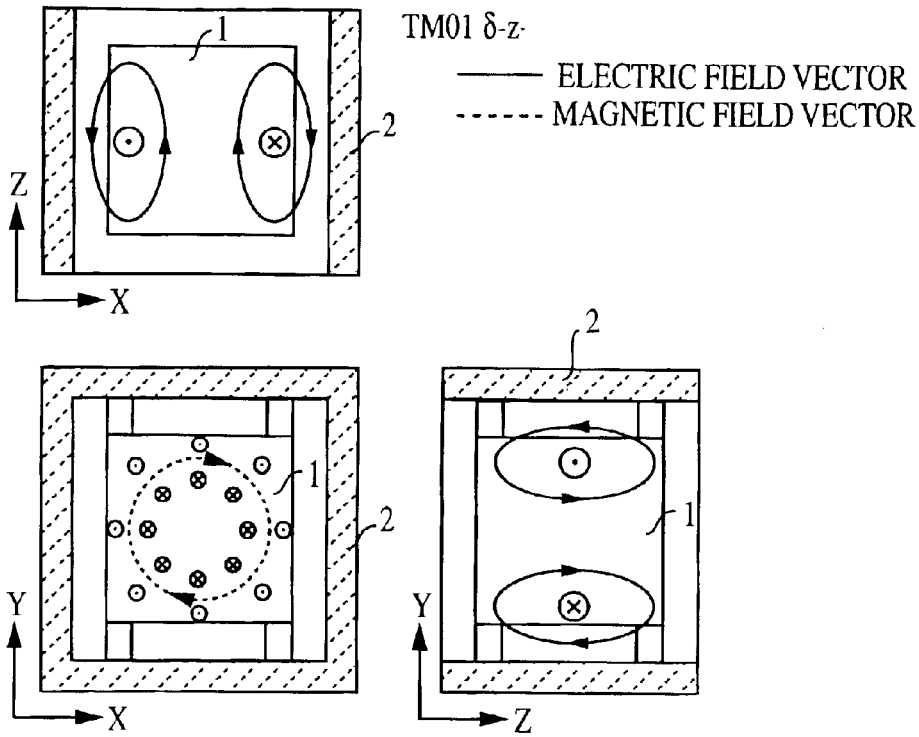
FIGS. 4(A,B) consists of cross sections showing the electromagnetic field distributions in the respective modes of the above resonator device.
Figure 4B:
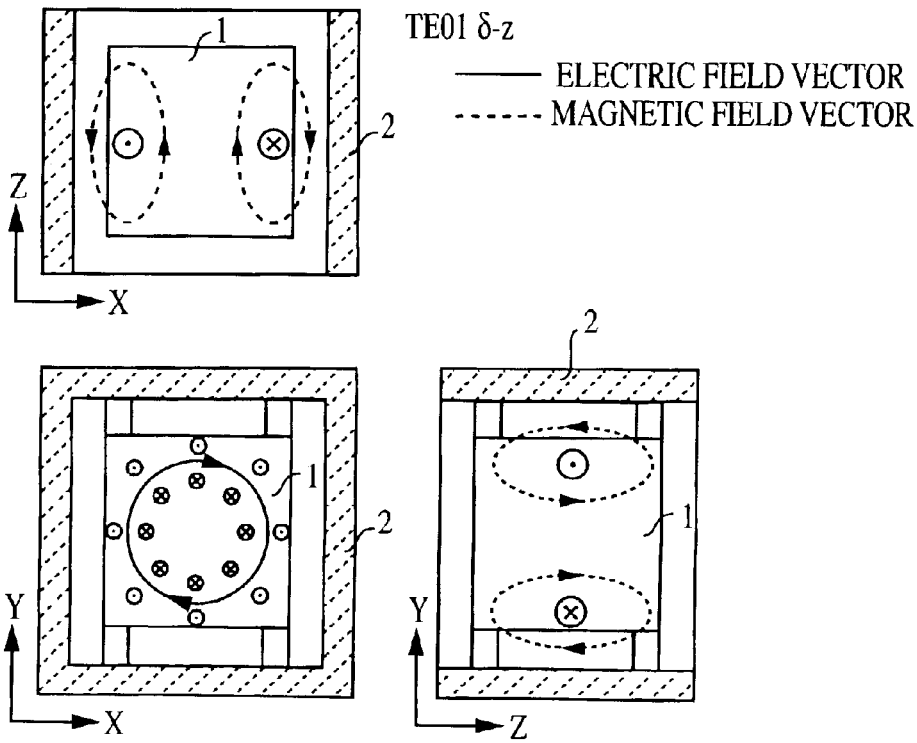

The resonance modes, caused by the dielectric core 1 shown in FIG. 1, are illustrated in FIGS. 2 to 4. In these figures, x, y, and z represent the co-ordinate axes in the three-dimensional directions shown in FIG. 1. FIGS. 2 to 4 show the cross-sections taken through the respective two-dimensional planes. In FIGS. 2 to 4, a continuous line arrow indicates an electric field vector, and a broken line arrow indicates a magnetic field vector. The symbols "·" and "×" represent the direction of an electric field and that of a magnetic field, respectively. FIG. 2 to 4 show only a total of six resonance modes, that is, the TM01δ modes in the three directions, namely, the x, y, and z directions, and the TE01δ modes in the same three directions as described above. In practice, higher resonance modes exist. In ordinary cases, these fundamental modes are used.

Next, the configuration of a multimode dielectric resonator device according to a second embodiment will be described with reference to FIGS. 5 to 8.

Figure 5:
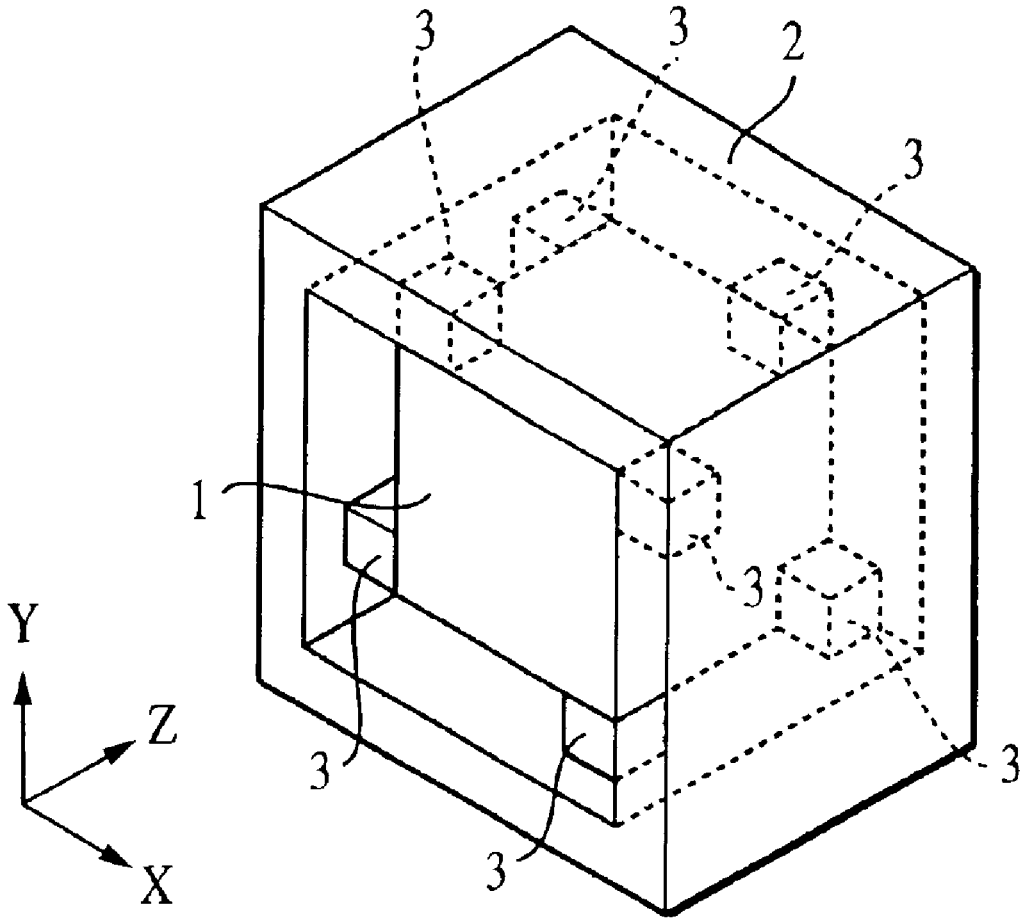
FIG. 5 is a perspective view showing the basic portion of a multimode dielectric resonator device according to a second embodiment.

FIG. 5 is a perspective view showing the basic constitution portion of a multimode resonator device. In this figure, reference numerals 1, 2, and 3 designate a substantially parallelepiped-shaped dielectric core, an angular pipe-shaped cavity, and supports for supporting the dielectric core 1 substantially in the center of the cavity 2. A conductor film is formed on the outer peripheral surface of the cavity 2. In this example, two supports 3 are provided on each of the four inner walls of the cavity, respectively. The other configuration is the same as that in the first embodiment.

Figure 6A:
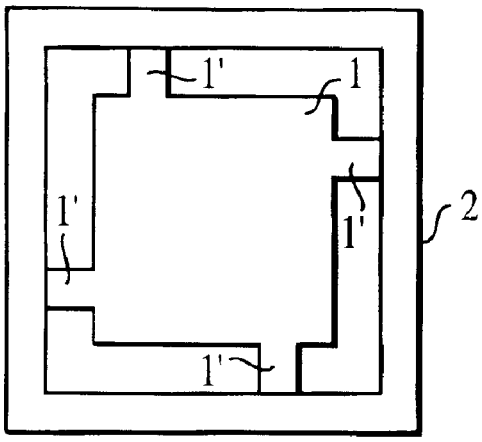
FIGS. 6(A,B,C) illustrates an example of a process of manufacturing the above resonator device.
Figure 6B:
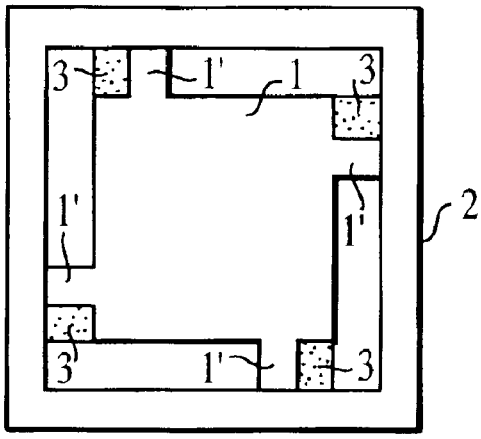
Figure 6C:
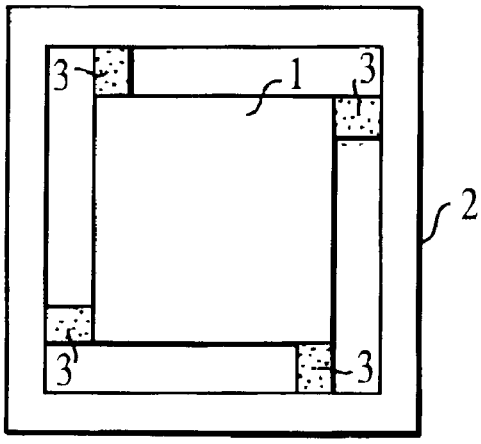

FIG. 6 shows an example of a process of producing the multimode dielectric resonator device shown in FIG. 5. First, as shown in (A), the dielectric core 1 is molded integrally with the cavity 2 in the state that the dielectric core 1 and the cavity 2 are connected by means of connecting parts 1'. Hereupon, molds for the molding are opened in the axial direction of the cavity 2, through the open faces of the angular pipe-shaped cavity 2. Subsequently, as shown in (B), the supports 3 are temporarily bonded with a glass glaze in paste state, adjacently to the connecting parts 1' and in the places corresponding to the respective corner portions of the dielectric core 1. Further, Ag paste is applied to the outer peripheral surface of the cavity 2. Thereafter, the supports 3 are baked to bond to the dielectric core 1 and the inner walls of the cavity 2 (bonded with the glass glaze), simultaneously when an electrode film is baked. Thereafter, the connecting parts 1' are scraped off to produce the structure in which the dielectric core 1 is mounted in the center of the cavity 2 as shown in (C) of the same figure. In this case, for the dielectric core 1 and the cavity 2, a dielectric ceramic material of ZrO2—SnO2—TiO2 type with ∈ r=37 and tan δ=1/20,000 is used. For the supports 3, a low dielectric constant dielectric ceramic material of 2MgO—SiO2 type with ∈ r=6 and tan δ=1/2,000 is used. Both have nearly equal liner expansion coefficients. No excess stress is applied to the bonding surfaces between the supports and the dielectric core or the cavity, when the dielectric core is heated, and the environmental temperature is changed.

In the above respective embodiments, a single support is described as an example. The supports may be molded integrally with the dielectric core or the cavity, or all of the supports, the cavity, and the dielectric core may be integrally molded.

Figure 7:
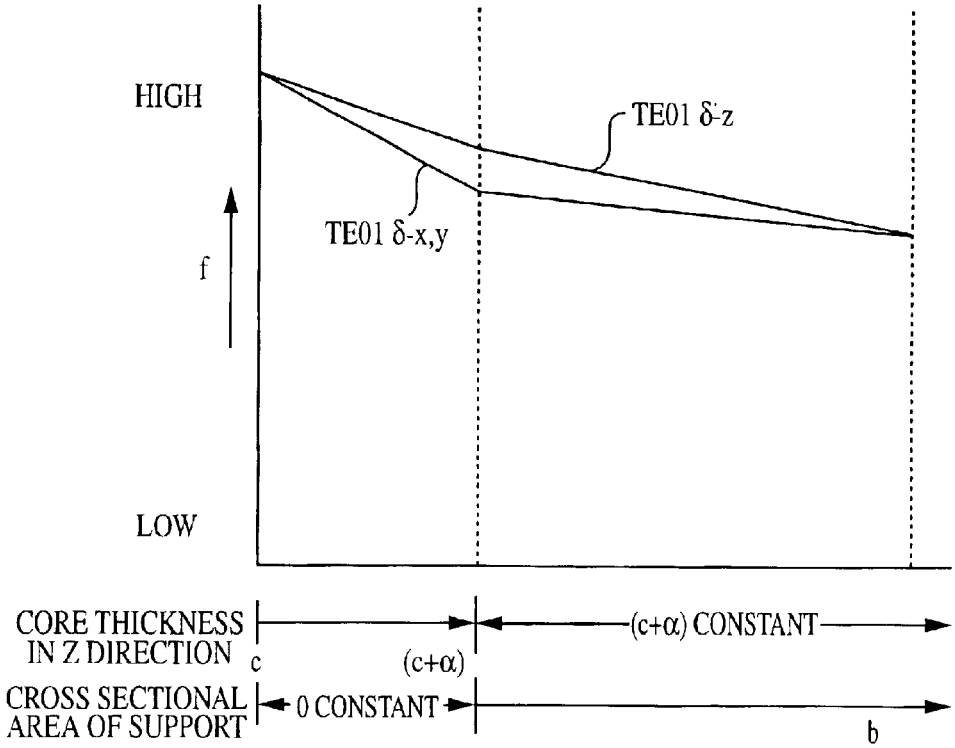
FIG. 7 is a graph showing the changes of the resonance frequencies of the respective modes, occurring when the sizes of the portions of the resonator device are changed.

FIG. 7 shows the changes of the resonance frequencies of the TE01δ-x, TE01δ-y, and TE01δ-z modes, occurring when the thickness in the Z axial direction of the dielectric core 1 and the cross sectional area of the supports 3, shown in FIG. 5, are varied. As illustrated, with the thickness in the z axial direction of the dielectric core being increased, the resonance frequencies of the TE01δ-x and TE01δ-y modes are more reduced. Further, as the cross sectional area of each support is increased, the resonance frequency of the TE01δ-z mode is reduced more considerably. By designing appropriately the thickness in the z axial direction of the dielectric core 1 and the cross sectional area of each support 3 by utilization of these relations, the resonance frequencies of the three modes of TE01δ-x, TE01δ-y, and TE01δ-z can be made coincident with each other. Thus, by coupling predetermined resonance modes to each other, the multistage can be realized.

Figure 8:
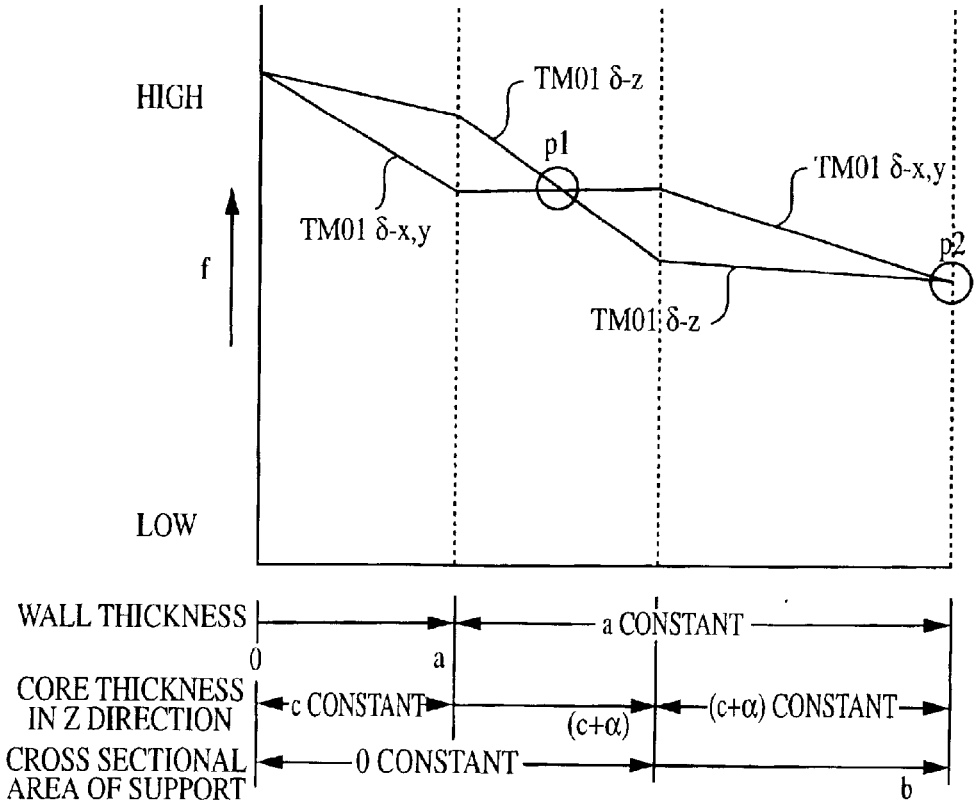
FIG. 8 is a graph showing the changes of the resonance frequencies of the respective modes, occurring when the sizes of the portions of the resonator device are changed.

FIG. 8 shows the changes of the resonance frequencies of the above-described three TM modes, occurring when the wall thickness of the cavity 2, the thickness in the Z axial direction of the dielectric core 1 and the cross sectional area of the supports 3, shown in FIG. 5, are varied. When only the wall thickness of the cavity is thickened, the resonance frequencies of the TM01δ-x and TM01δ-y modes are reduced more considerably as compared with the resonance frequency of the TM01δ-z mode. When the thickness in the z axial direction of the dielectric core is thickened, the resonance frequency of the TM01δ-z mode is reduced more considerably as compared with the resonance frequencies of the TM01δ-x, TM01δ-y modes. When the cross sectional area of each support is increased, the resonance frequencies of the TM01δ-x, TM01δ-y modes are reduced more considerably as compared with the resonance frequency of the TM01δ-z mode. By utilization of these relations, the resonance frequencies of the three modes can be made coincident with each other at characteristic points, designated by p1 and p2 in the figure, for example.

Figure 9:
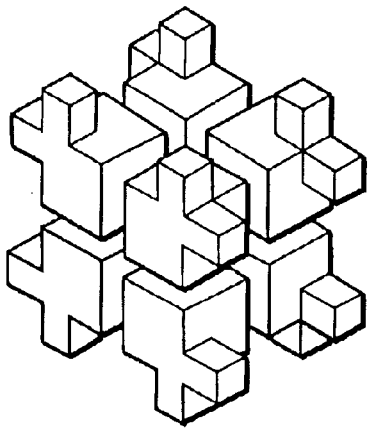
FIG. 9 is a perspective view showing the constitution of the dielectric core portion of a multimode dielectric resonator device according to a third embodiment.

FIG. 9 is a perspective view showing the configuration of the dielectric core portion of a multimode dielectric resonator device according to a third embodiment. As already described with reference to FIGS. 2 to 4, in the TE01δ modes, the electric field components are concentrated onto the vicinity of the respective cross sections which divide the dielectric core into eight portions. On the other hand, such concentration doesn't occur in the TM01δ modes, and therefore, as shown in FIG. 9, by forming a cross-shaped groove in each of the faces of the dielectric core, each groove crossing at the center of the face, the resonance frequencies of the TE01δ modes can be selectively increased.

Figure 10:
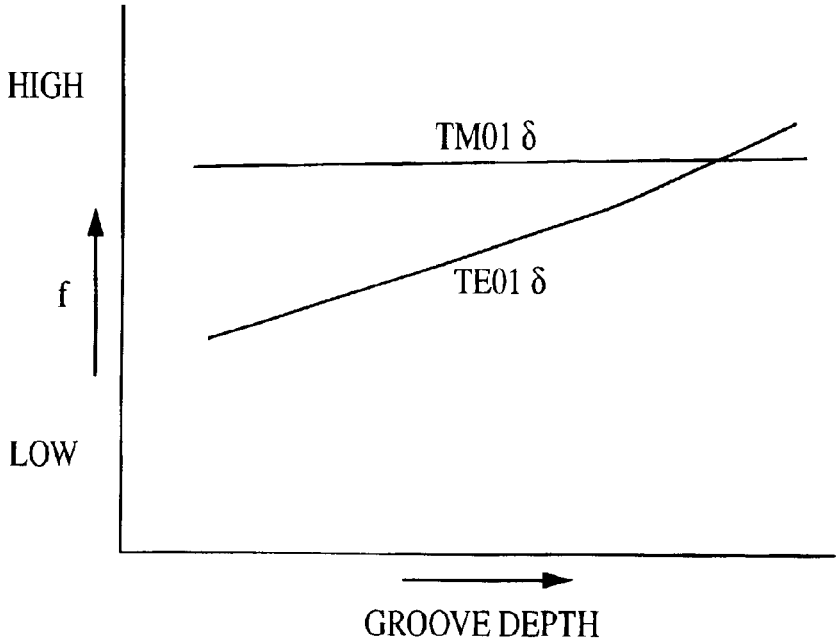
FIG. 10 is a graph showing the changes of the resonance frequencies of the respective modes, occurring when the depth of a groove of the above resonator device is changed.

FIG. 10 is a graph showing the relations between the groove depth and the changes of the resonance frequencies of the both modes. When no groove is provided, generally, the resonance frequency of the TE01δ mode is lower than that of the TM01δ mode. In the case where the grooves g are provided, with the depth being deeper, the resonance frequency of the TM01δ mode is increased, and at a point, becomes coincident with the resonance frequency of the TE01δ mode. Further, in the case where the groove depth is constant, and the groove width is widened, the resonance frequency of the TE01δ mode can be selectively increased with the groove width being wider. In the case where the resonance frequency of the TE01δ mode is lower than that of TM01δ mode, caused by the respective sizes of the dielectric core, the cavity, and the supports, and the relative dielectric constants of respective portions, and so forth, without the above grooves being provided, the resonance frequency of the TE01δ mode and that of the TM01δ mode can be coincident with each other by forming the grooves in the dielectric core as described above. By making the resonance frequencies of the both modes coincident with each other, and coupling the both modes, a multistage can be realized.

Next, the configuration of a multimode dielectric resonator device in which the TM01δ modes are coupled to each other will be described with reference to FIGS. 11 to 14.

Figure 11:
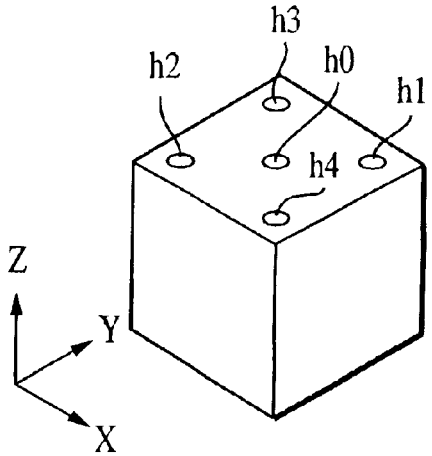
FIG. 11 is a perspective view showing a dielectric core portion for use in description of the coupling means for coupling the respective resonance modes of each of the multimode resonator devices according to fourth to sixth embodiments.

FIG. 11 is a perspective view showing a dielectric core portion. In the figure, reference numerals h0 to h4 designate holes for use in adjusting the coupling coefficient obtained between predetermined modes.

Figure 12A:
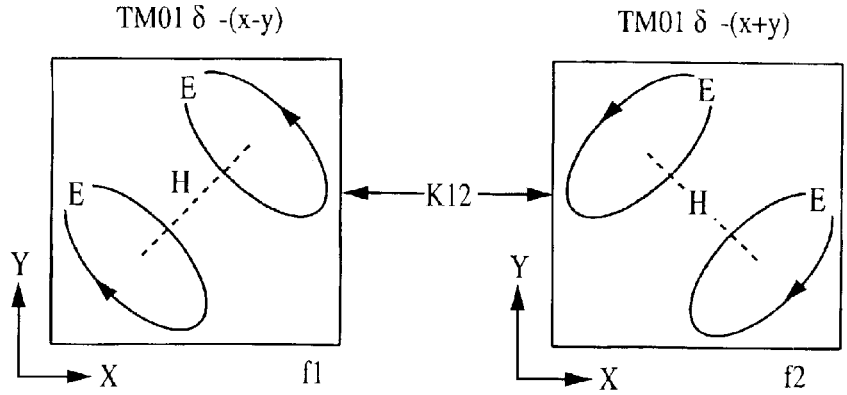
FIGS. 12(A,B) illustrates examples of the electromagnetic field distributions caused when the two TM modes of the multimode dielectric resonator device according to a fourth embodiment are coupled to each other.
Figure 12B:
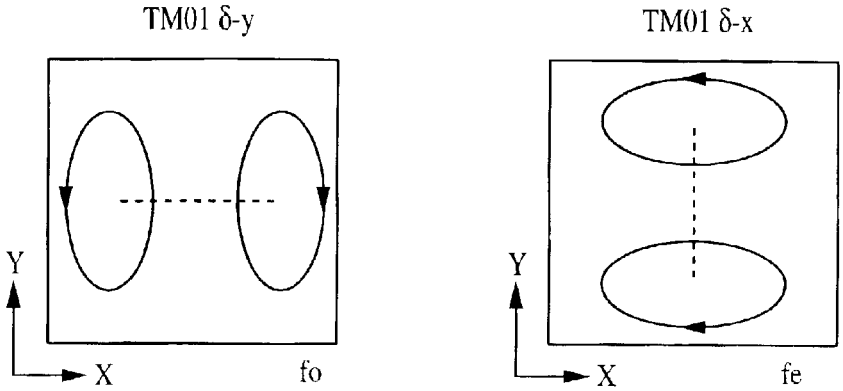

FIG. 12 illustrates the electromagnetic field distributions of the respective modes. Hereupon, a continuous line arrow indicates an electric field, and a broken line does a magnetic field. In (A) illustrated are the electromagnetic distributions of two main modes to be coupled, that is, the TM01δ-(x−y) mode and the TM01δ-(x+y) mode, respectively. In (B), illustrated are the electromagnetic distributions of an odd mode and an even mode which are the coupled modes. In this example, the odd mode can be expressed by a TM01δ-y mode, and the even mode by a TM01δ-x mode.

Figure 13:
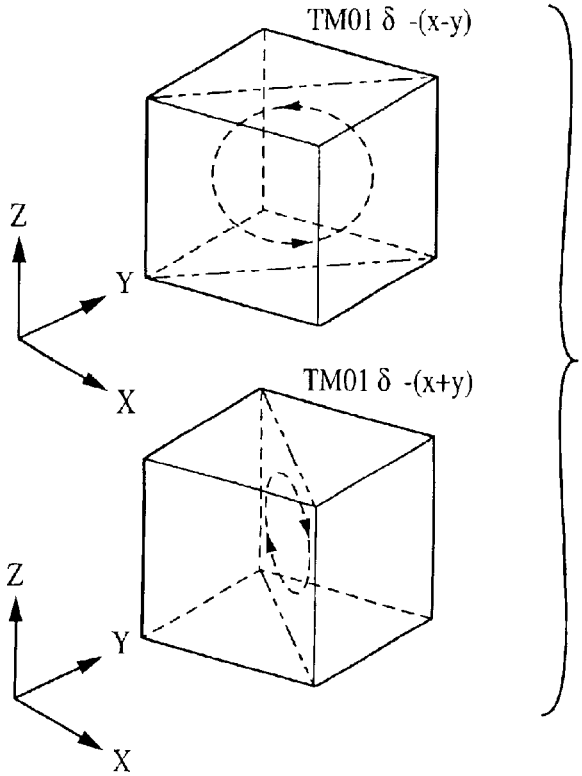
FIG. 13 consists of perspective views showing examples of the magnetic field distributions of the two resonance modes of the above resonator device.

FIG. 13 consists of perspective views showing the magnetic field distributions of the above main modes, respectively. When the resonance frequency of the odd mode is represented by fo, and that of the even mode by fe, the coupling coefficient k12 of the two mode is expressed by the following formula.

$$k12 \geqq 2(fo-fe)/(fo+fe)$$

Figure 14:
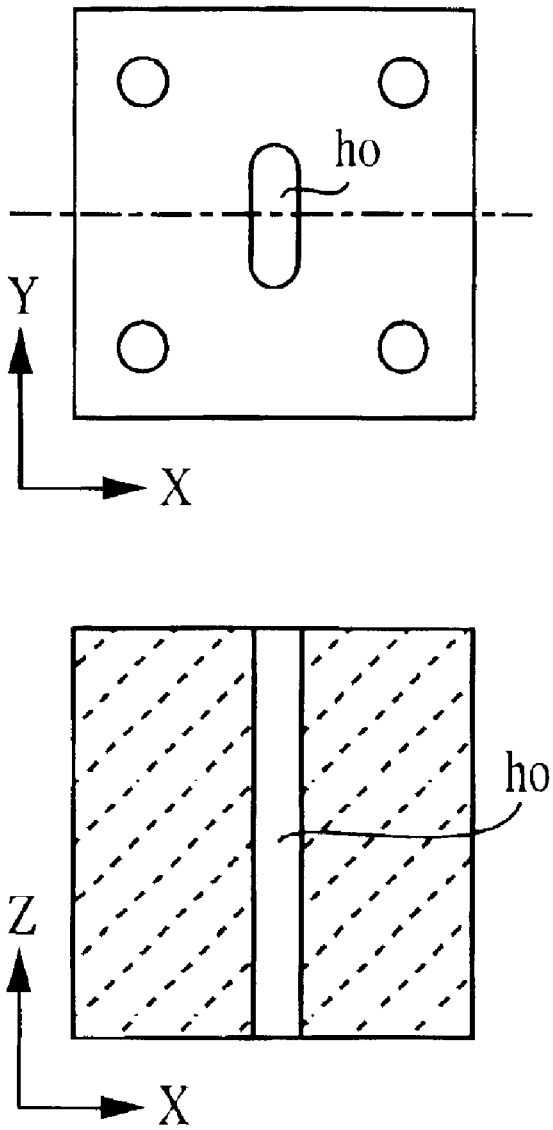
FIG. 14 illustrates the constitutions of coupling holes for coupling the two resonance modes of the above resonator device.

Accordingly, the main modes, that is, the TM01δ-(x−y) mode and the TM01δ-(x+y) mode are coupled by providing a difference between the fo and fe. Accordingly, as shown in FIG. 14, a hole ho lying in the center of the dielectric core is elongated in the y axial direction. That is, by forming a groove elongating in parallel to the direction of the electric field of TM01δ-y and perpendicularly to the direction of the electric field of TM01δ-x, the relation of fe>fo is obtained. On the contrary, by elongating the hole ho in the axial direction, the relation of fe<fo is obtained. In either case, coupling can be achieved at a coupling coefficient corresponding to the fo and fe.

In the above example, the TM01δ-(x−y) mode and the TM01δ-(x+y) mode are main modes, and the TM01δ-y mode and the TM01δ-x mode are coupled modes. On the contrary, the TM01δ-y mode and the TM01δ-x mode may be main modes, and the TM01δ-(x−y) mode and the TM01δ-(x+y) mode may be coupled modes. In this case, the inner diameter of the hole ho shown in FIG. 14 may be lengthened in a diagonal direction.

Figure 15A:
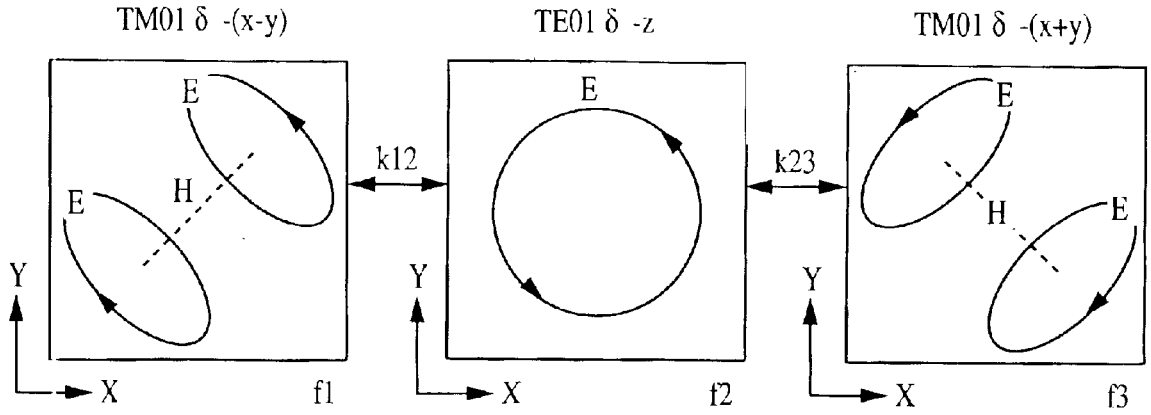
FIGS. 15(A,B,C) illustrates electromagnetic distributions, and the configurations of coupling-conditioning holes in a multimode dielectric resonator device according to a fifth embodiment.
Figure 15B:
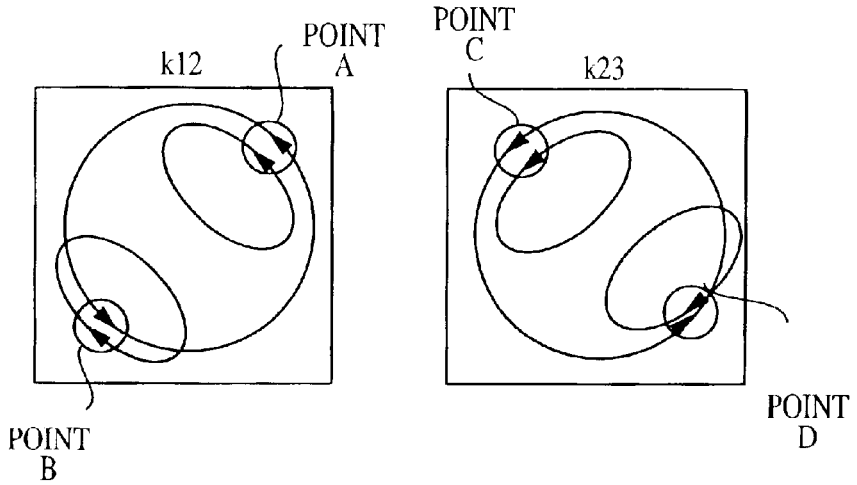
Figure 15C:
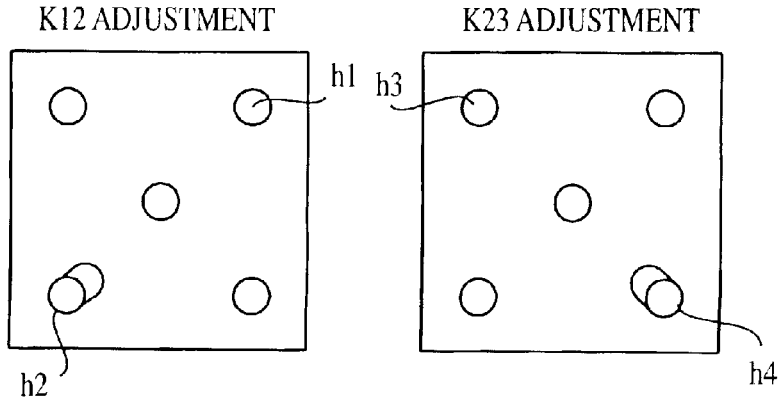

FIG. 15 illustrates that a TM mode and a TE mode are coupled to each other, and particularly, three modes are sequentially coupled to each other, as an example. The configuration of the dielectric core is the same as that shown in FIG. 11. In FIG. 15, in (A), illustrated are the electromagnetic field distributions of the three modes, that is, the TM01δ-(x−y), TE01δ-z, and TM01δ-(x+y) modes, respectively. A continuous line arrow indicates an electric field, and a broken line a magnetic field. In (B), illustrated are the coupling relations between the above-described TE mode and the other two TM modes. The figure presented in the left-hand side of (B) shows the electric distribution of the TM01δ-(x−y) mode, and that of the TE01δ-z mode which overlap each other. By breaking the balance of the electric field strengths at points A and B, energy is transferred from the TM01δ-(x−y) mode to the TE01δ-z mode. Accordingly, as shown in the figure presented in the left hand side of (C) of the same figure, the coupling coefficient k12 is adjusted by widening the inner diameter of a hole h2 to provide a difference between the hole h2 and a hole h1.

Similarly, the figure presented in the right-hand side of (B) shows the electric distributions of the TE01δ-z mode, and that of the TM01δ-(x+y) mode which overlap each other. In this case, by breaking the balance of the electric field strengths at points C and D, energy is transferred from the TE01δ-z mode to the TM01δ-(x+y) mode. Accordingly, as shown in the figure presented in the right-hand side of (C) of the same figure, the coupling coefficient k 23 is adjusted by widening the inner diameter of a hole h4 to provide a difference between the hole h4 and a hole h3.

Figure 16:
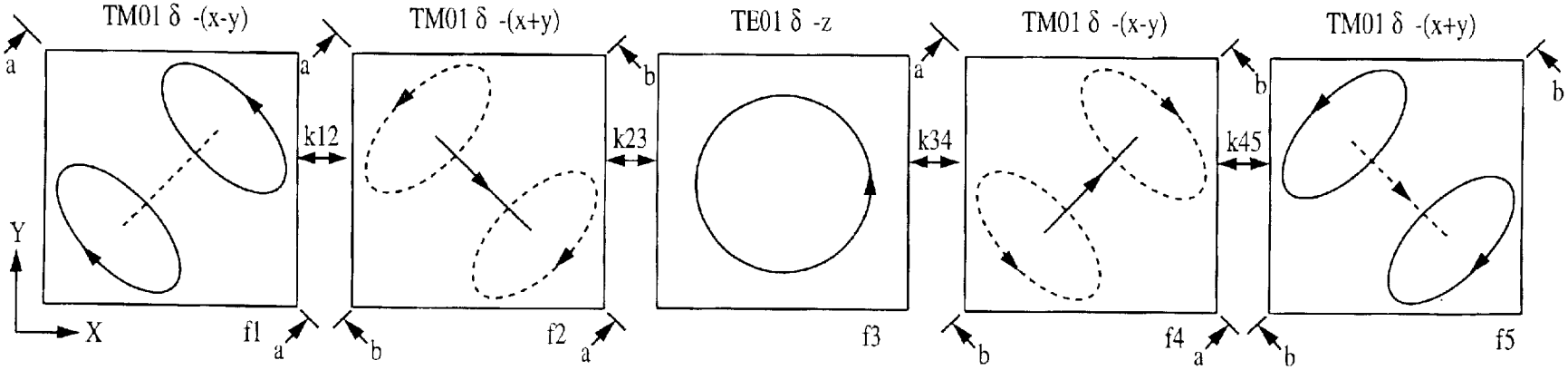
FIG. 16 illustrates the electromagnetic field distributions of the respective modes in a multimode dielectric resonator device according to the sixth embodiment.

FIG. 16 illustrates an example of coupling five resonance modes sequentially, which is operated as a five stage resonator, as an example. The configuration of the dielectric core is the same as that shown in FIG. 11. In FIG. 16, a continuous line indicates an electric field distribution, and a broken line a magnetic field distribution.

Figure 17A:
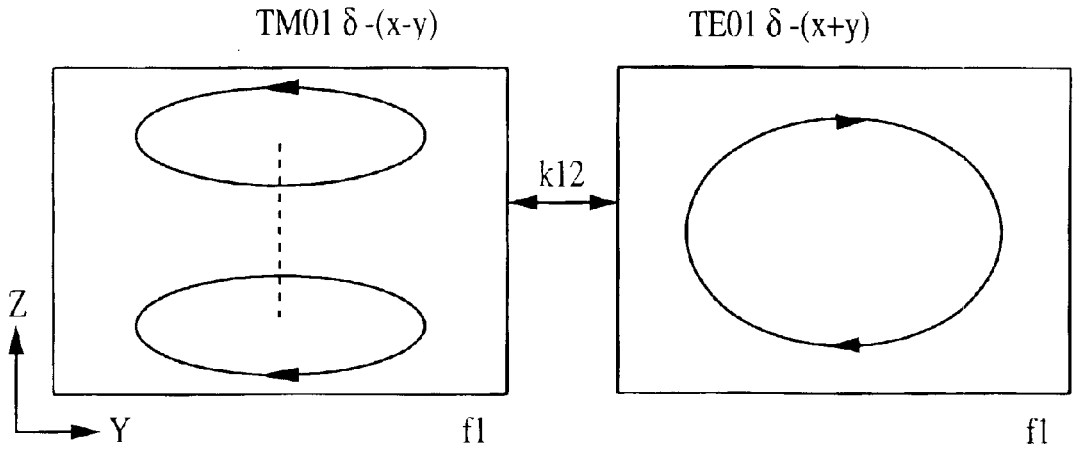
FIGS. 17(A,B) illustrates the electromagnetic field distributions of two modes in the cross sections of the a—a portions shown in FIG. 16.
Figure 17B:
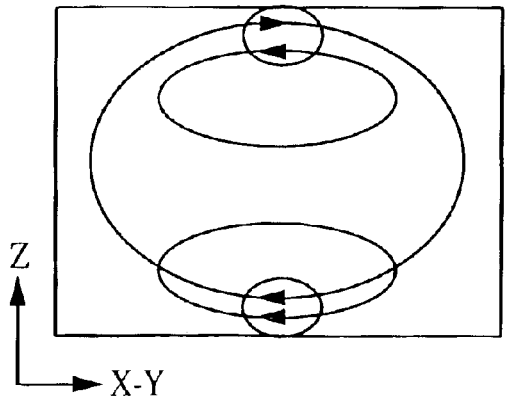
Figure 18A:
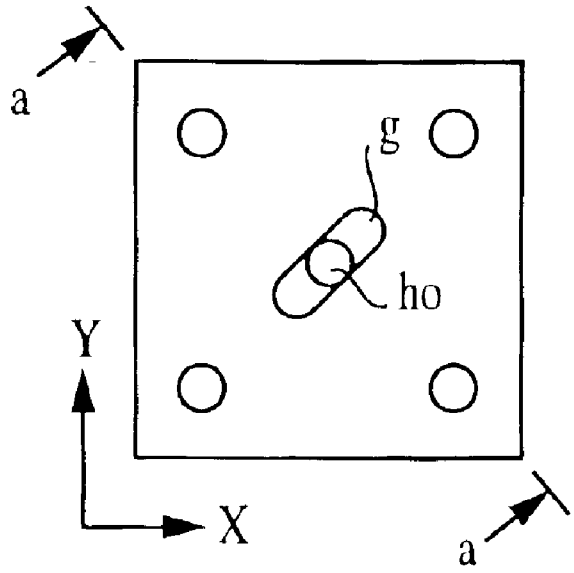
FIGS. 18(A,B) illustrates the configuration of a coupling-conditioning groove for the resonance modes in the first and second stages shown in FIG. 16.
Figure 18B:
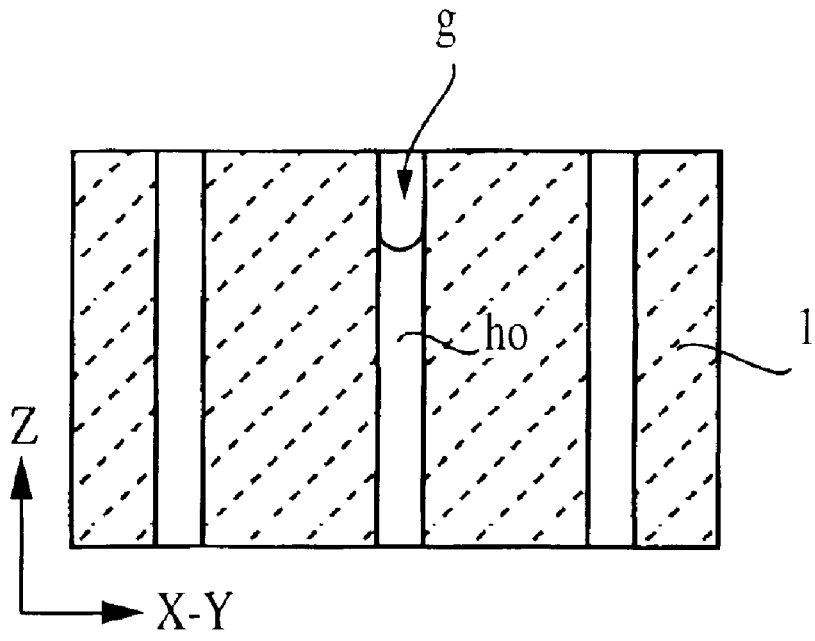

First, the coupling of TM01δ-(x−y) and TE01δ-(x+y) will be discussed. FIG. 17 illustrates the electromagnetic field distributions of the above two modes in the cross sections taken through the a-a portion in FIG. 16. In (B), illustrated are the electromagnetic field distributions of the two modes which overlap each other. By breaking the balance of the electric field strengths of the TM01δ-(x−y) and the TE01δ-(x+y) in the a-a cross section, energy is transferred from the TM01δ-(x−y) mode to the TE01δ-(x+y) mode. Accordingly, as shown in FIG. 18, the size of the hole is made different at the upper side and the underside in the a—a cross section.

In the example shown in this figure, a groove g elongating in the (x+y) axial direction is provided in the upper side of the dielectric core 1

Figure 19A:
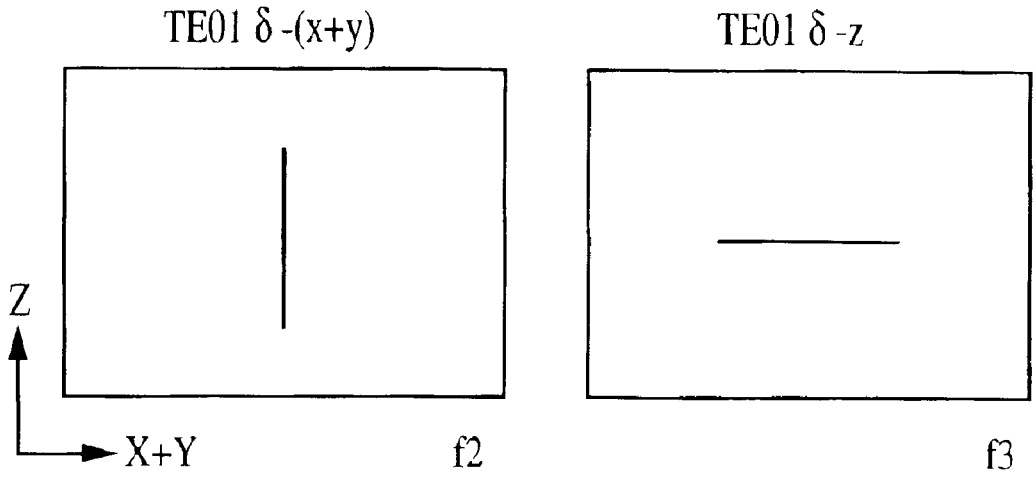
FIGS. 19(A,B) illustrates the electric field distributions in the cross sections of the b—b portions shown in FIG. 16.
Figure 19B:
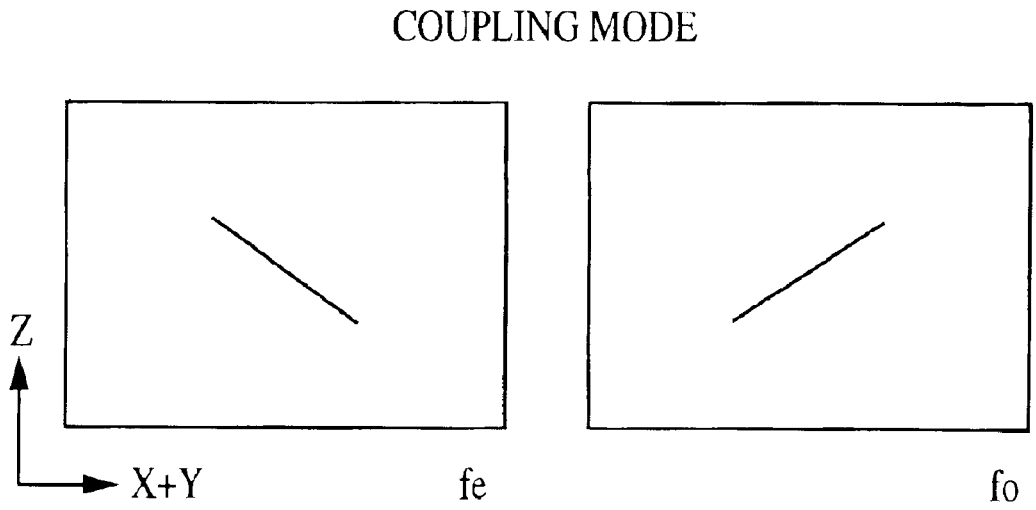
Figure 20A:
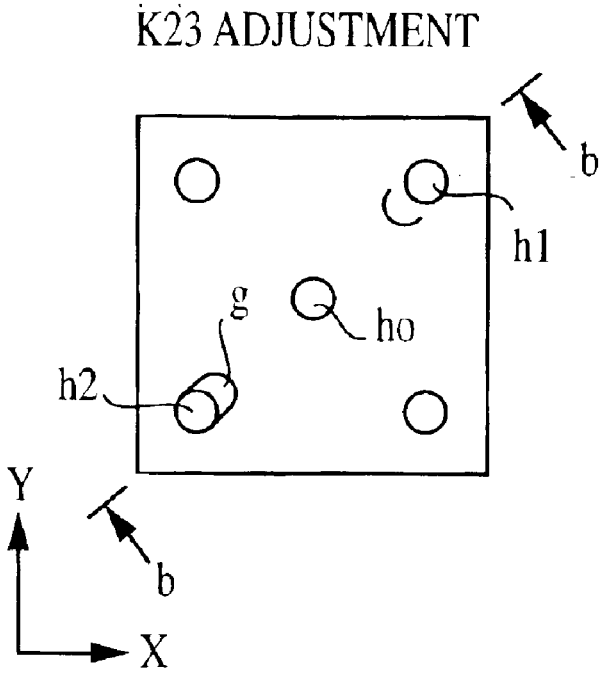
FIGS. 20(A,B) illustrates the configuration of a groove for coupling the resonance modes in the second and third stages shown in FIG. 16.
Figure 20B:
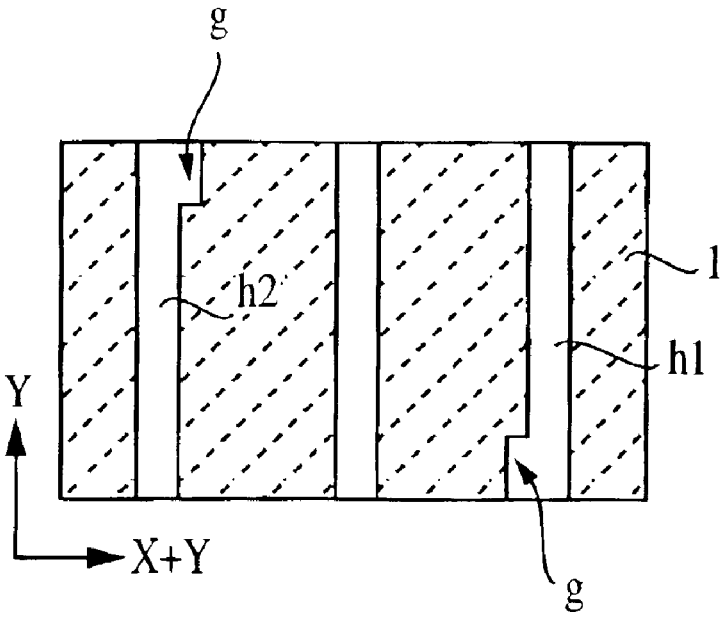

Next, the coupling of the TE01δ-(x+y) mode and the TE01δ-z mode will be discussed. FIG. 19 (A) illustrates the electric field distributions of the above-described two modes in the cross section of the b-b portion of the dielectric core. Further, in (B), illustrated are the electric field distributions of an even mode and an odd mode which are the coupled modes. When the above-described two modes are coupled to each other, it is suggested that a difference is given between the resonance frequency fe of the even mode and that of the odd mode. For this purpose, as shown in FIG. 20, the symmetry of the cross section of the b—b portion with respect to the diagonal direction is broken. In this example, grooves g are formed in the vicinity of the open-portion at the upper side of a hole h2 and that of the open-end at the underside of a hole h1, respectively. Thereby, the resonance frequency fe of the even mode shown in FIG. 19 (B) becomes higher than the resonance frequency fo of the odd mode. The TE01δ-(x+y) and the TE01δ-z mode are coupled at a coupling coefficient corresponding to the difference.

Figure 21A:
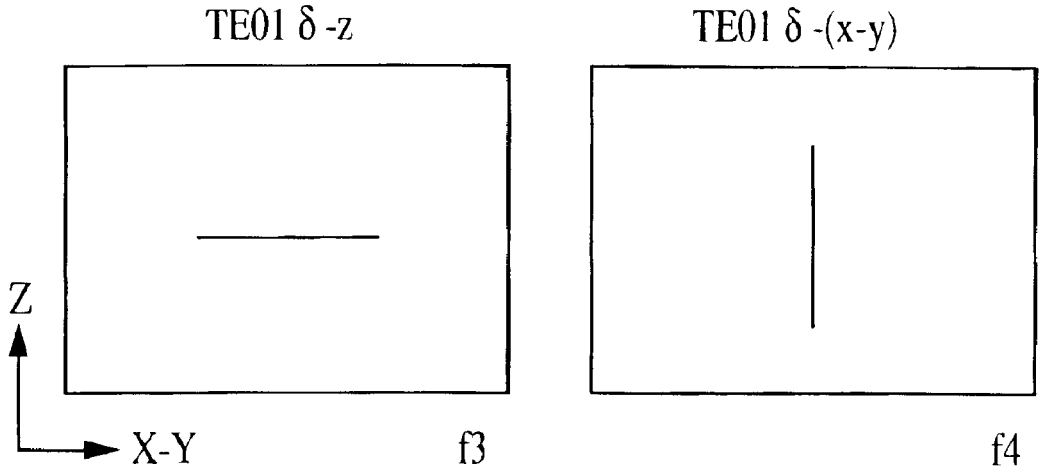
FIGS. 21(A,B) illustrates the electric field distributions in the cross sections of the a—a portions shown in FIG. 16.
Figure 21B:
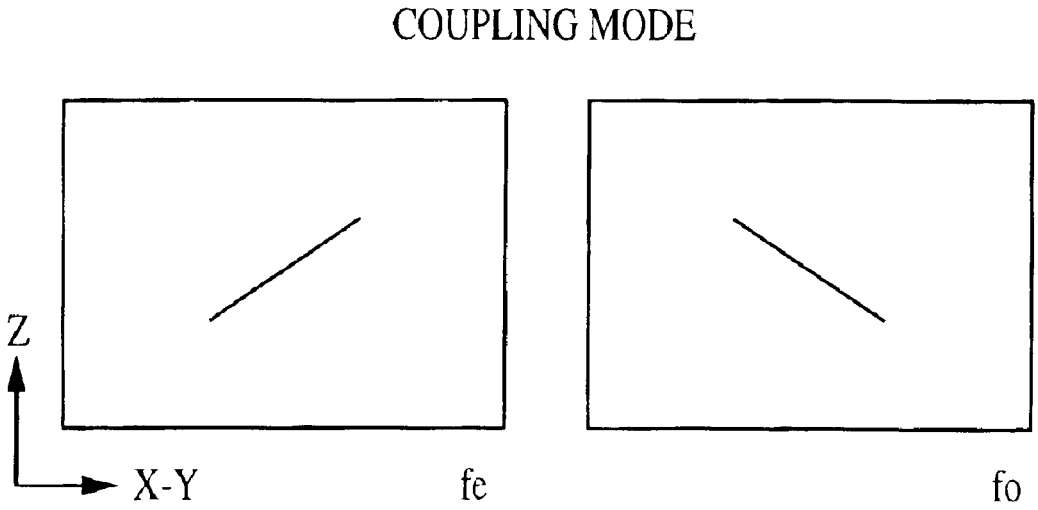
Figure 22A:
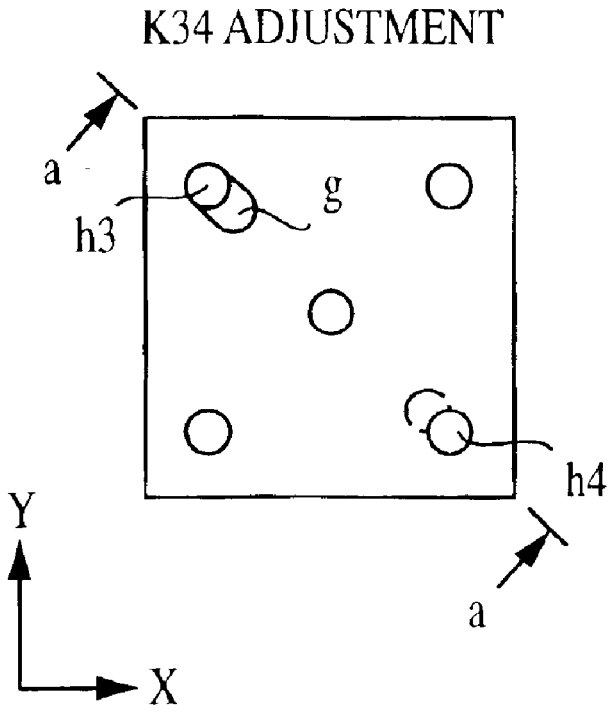
FIGS. 22(A,B) illustrates the configuration of a groove for coupling-conditioning the resonance modes in the third and fourth stages shown in FIG. 16.
Figure 22B:
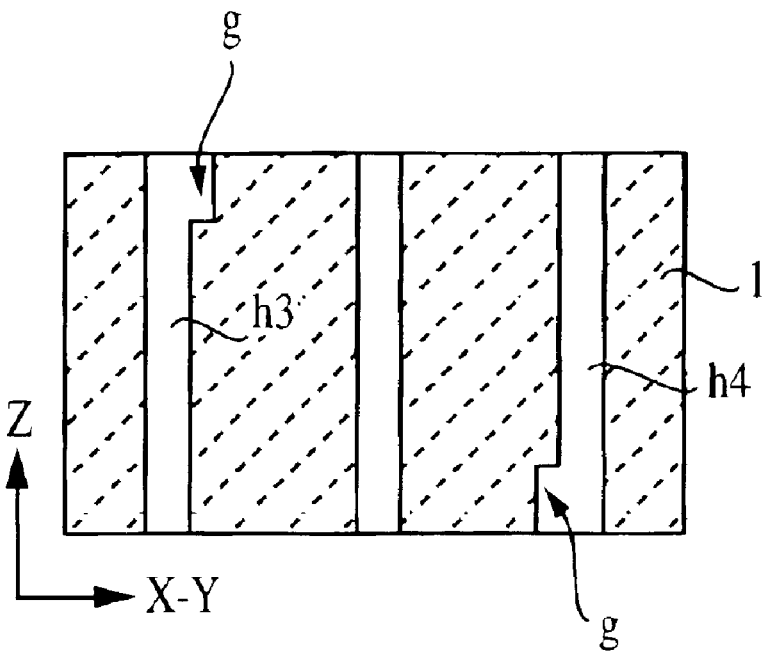

Next, the coupling of the third stage and the fourth stage shown in FIG. 16, that is, the coupling of the TE01δ-z mode and the TE01δ-(x−y) mode will be discussed. FIG. 21 illustrates the electric field distributions of the above-described two modes in the cross section of the a—a portion of the dielectric core. In (B), illustrated are the electric field distributions of an even mode and an odd mode, which are the coupled modes. When the above-described two modes are coupled, it is suggested that a difference is given between the resonance frequency fe of the even mode and the resonance frequency of the odd mode. For this purpose, as shown in FIG. 22, the symmetry of the cross section of the a—a portion with respect to the diagonal direction is broken. In this example, grooves g are formed in the vicinity of the open-portion at the upper side of a hole h3 and that of the open-end at the underside of a hole h4, respectively. Thereby, the resonance frequency fo of the odd mode shown in FIG. 21(B) becomes higher than the resonance frequency fe of the even mode. The TE01δ-z and the TE01δ-(x−y) mode are coupled at a coupling coefficient corresponding to the difference.

Figure 23A:
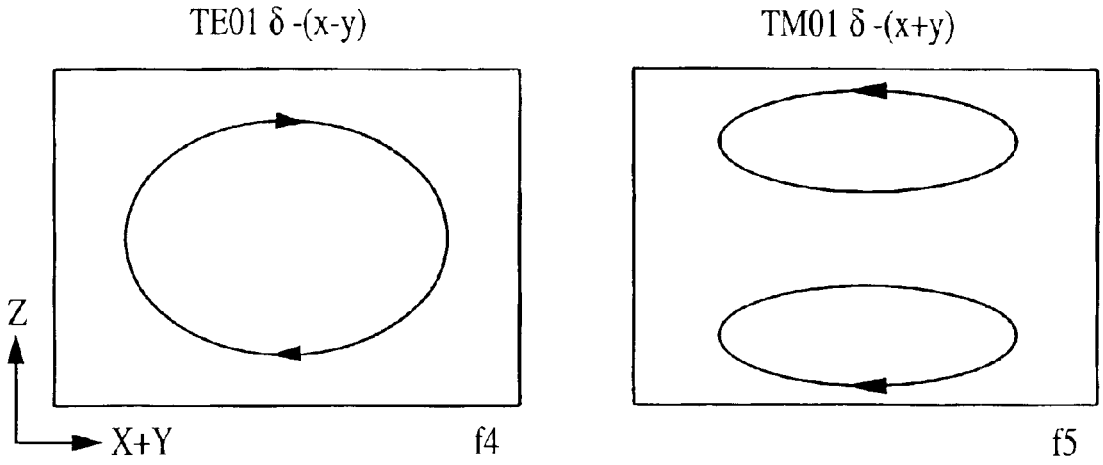
FIGS. 23(A,B) illustrates the electric field distributions in the cross sections of the b—b portions shown in FIG. 16.
Figure 23B:
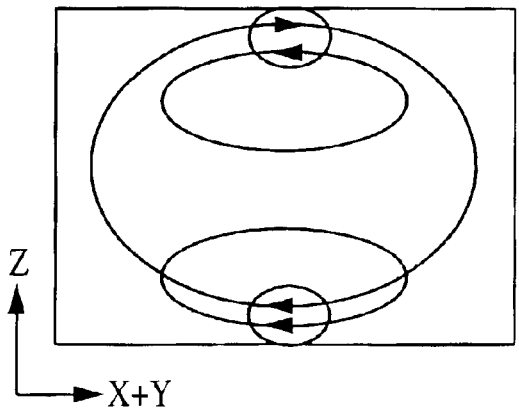
Figure 24A:
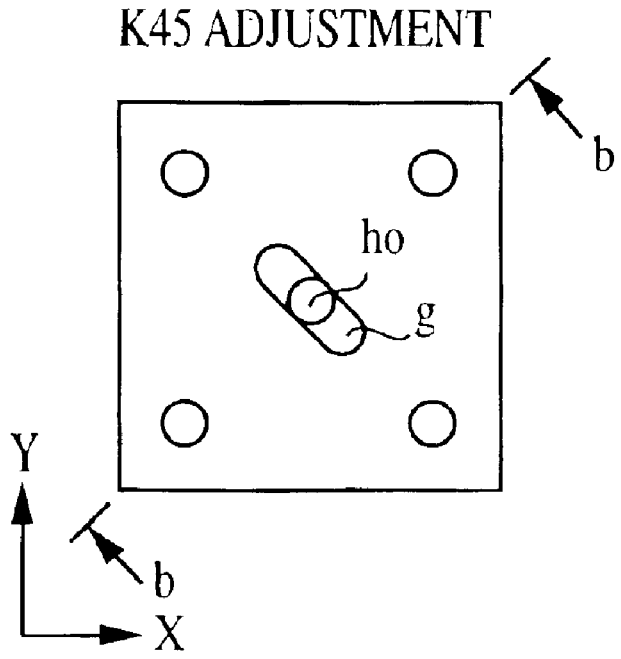
FIGS. 24(A,B) illustrates the configuration of a groove for coupling-conditioning the resonance modes in the fourth and fifth stages shown in FIG. 16.
Figure 24B:
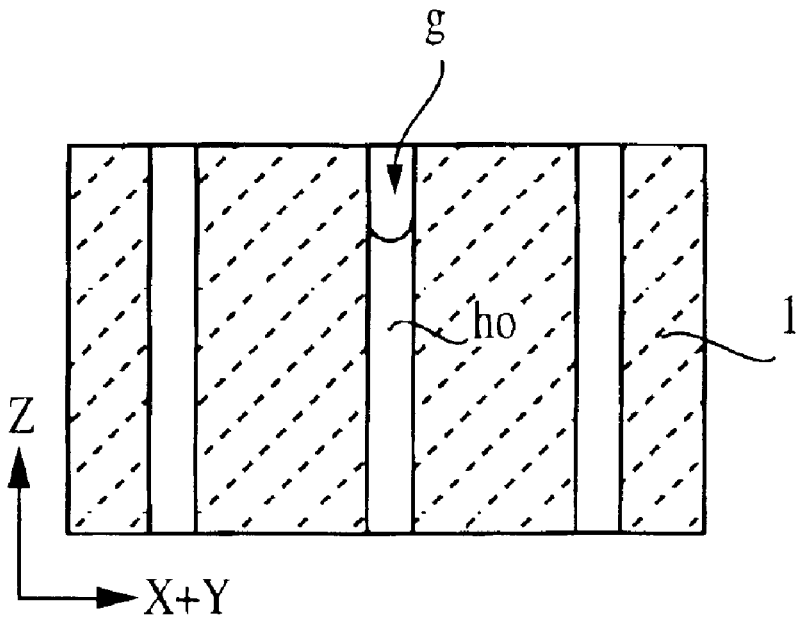

Next, the coupling of TE01δ-(x−y) and TM01δ-(x+y) shown in FIG. 16 will be discussed. FIG. 23(A) illustrates the electromagnetic field distributions of the above two modes in the cross sections of the b—b portion in FIG. 16. In (B), illustrated are the electromagnetic field distributions of the two modes which overlap each other. By breaking the balance of the electric field strengths of the TE01δ-(x−y) and the TM01δ-(x+y) in the b—b cross section, as described above, energy is transferred from the TE01δ-(x−y) mode to the TM01δ-(x+y) mode. Accordingly, as shown in FIG. 24, the sizes of the hole at the upper side and the underside in the b—b cross section are made different. In the example shown in this figure, a groove g elongating in the (x−y) axial direction in the upper side of the dielectric core 1 is provided.

In the above-described embodiment, coupling means for coupling the respective resonance modes of the dielectric core to an external circuit is not illustrated. For example, if a coupling loop is used, an external coupling may be achieved by disposing the coupling loop in the direction where the magnetic filed of a mode to be coupled passes as described later.

In the above described examples, plural resonance modes are sequentially coupled. However, an example of using the plural resonance modes independently, not coupling the respective resonance modes to each other, will be described with reference to FIG. 25 below.

Figure 25A:
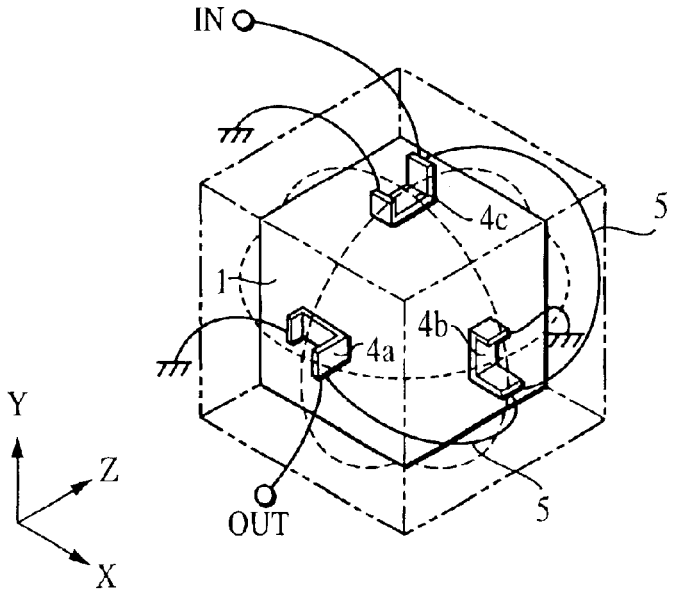
FIGS. 25(A,B) consists of perspective views each showing an example of the constitution of the major portion of the multimode dielectric resonator device according to the seventh embodiment.

In FIG. 25, a long and two short dashes line indicates a cavity where a dielectric core 1 is disposed. The supporting structure for the dielectric core 1 is omitted. An example of forming a band rejection filter is illustrated in (A) of this figure. Reference numerals 4*a*, 4*b*, and 4*c* each represent a coupling loop. The coupling loop 4*a* is coupled to a magnetic field (magnetic field of the TM01δ-x mode) in a plane parallel to the y−z plane, the coupling loop 4*b* is coupled to a magnetic field (magnetic field of the TM01δ-y mode) in a plane parallel to the x−z plane, and the coupling loop 4*c* is coupled to a magnetic field (magnetic field of the TM01δ-z mode) in a plane parallel to the x−y plane. One end of each of these coupling loops 4*a*, 4*b*, and 4*c* is grounded. The other ends of the coupling loops 4*a* and 4*b*, and also, the other ends of the coupling loops 4*b* and 4*c* are connected to each other through transmission lines 5, 5 each having an electrical length which is equal to λ/4 or is odd-number times of λ/4, respectively. The other ends of the coupling loops 4*a*, 4*c* are used as signal input-output terminals. By this configuration, a band rejection filter is obtained in which adjacent resonators of the three resonators are connected to a line with a phase difference of π/2.

Similarly, a band pass filter may be formed by coupling predetermined resonance modes through a coupling loop, and a transmission line, if necessary.

Figure 25B:
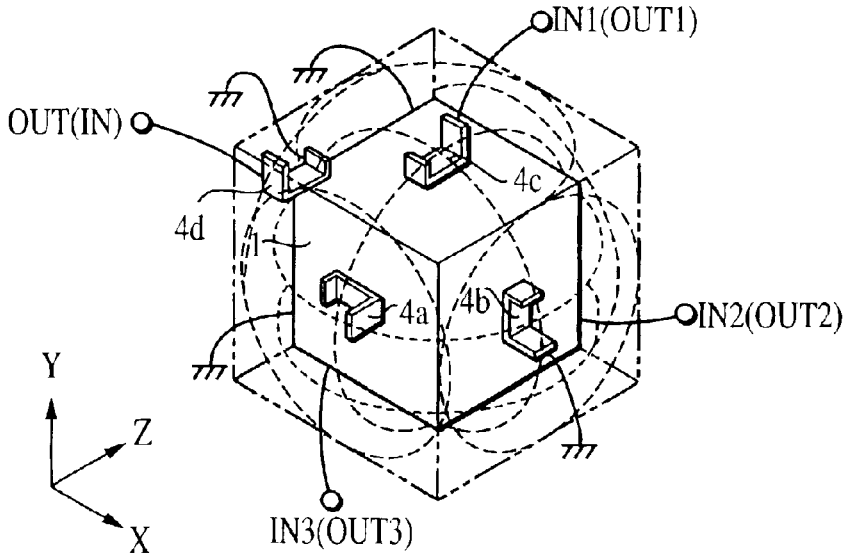
Figure 26A:
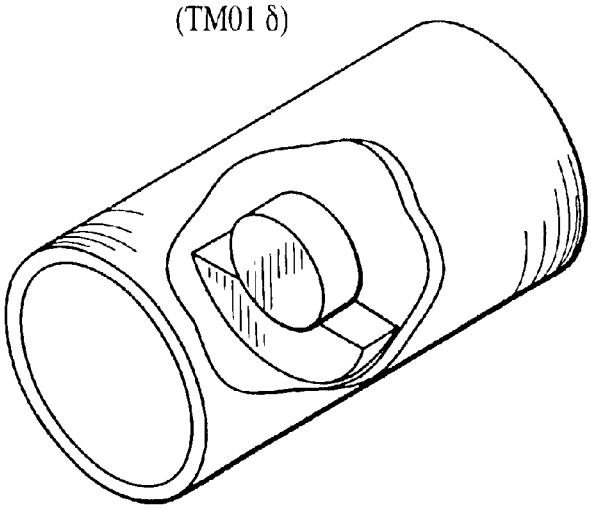
FIG. 26A PRIOR ART
FIGS. 26(A,B) consists of partially exploded perspective views each showing an example of the constitution of a conventional dielectric resonator device.
Figure 26B:
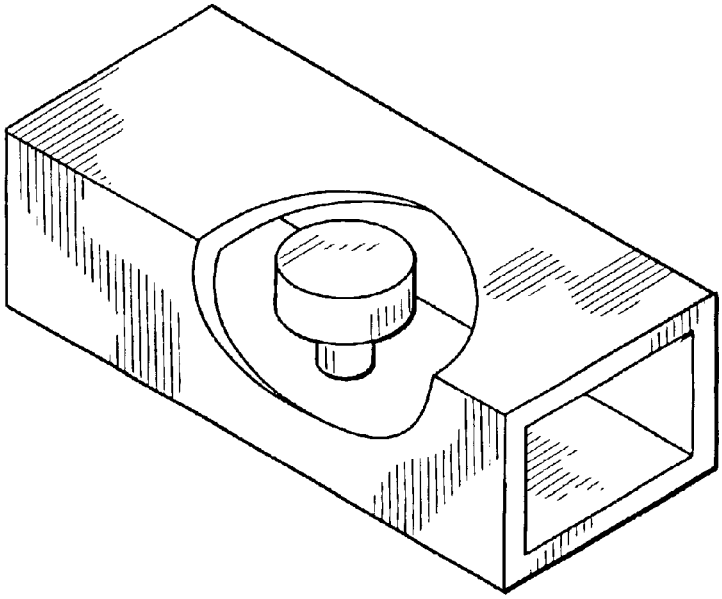
FIG. 26B PRIOR ART
Figure 27A:
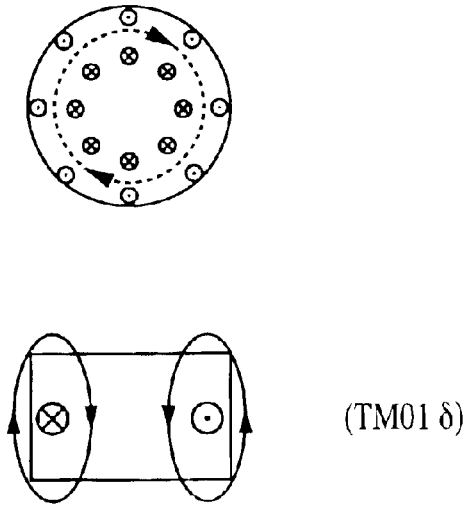
FIG. 27A PRIOR ART
FIGS. 27(A,B) illustrates examples of the electromagnetic field distributions in the conventional single mode dielectric resonator.
Figure 27B:
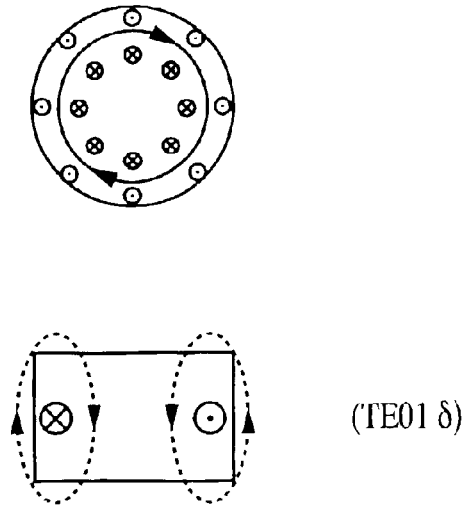
FIG. 27B PRIOR ART

FIG. 25(B) illustrates an example of forming a synthesizer or distributor. Hereupon, reference numerals 4*a*, 4*b*, 4*c*, and 4*d* designate coupling loops. The coupling loop 4*a* is coupled to a magnetic field (magnetic field of the TM01δ-x mode) in a plane parallel to the y−z plane. The coupling loop 4*b* is coupled to a magnetic field (magnetic field of the TM01δ-y mode) in a plane parallel to the x−z plane. The coupling loop 4*c* is coupled to a magnetic filed (magnetic field in the TM01δ-z mode) in a plane parallel to the x−y plane. Regarding the coupling loop 4*d*, the loop plane is inclined to any of the y−z plane, the x−z plane, and the x−y plane, and coupled to the magnetic fields of the above three modes, respectively. One ends of these coupling loops are grounded, respectively, and the other ends are used as signal input or output terminals. In particular, when the device is used as a synthesizer, a signal is input through the coupling loops 4*a*, 4*b*, and 4*c*, and outputs from the coupling loop 4*d*. When the device is used as a distributor, a signal is input through the coupling loop 4*d*, and output from the coupling loops 4*a*, 4*b*, and 4*c*. Accordingly, a synthesizer with three inputs and one output or a distributor with one input and three outputs are obtained.

In the above example, the three resonance modes are utilized, independently. At least four modes may be utilized. Further, a composite filter in which a band-pass filter and a band-rejection filter are combined can be formed by coupling some of the plural resonance modes sequentially to form the band-pass filter, and making the other resonance modes independent to form the band-rejection filter.

Next, an example of a triplex mode dielectric resonator device will be described with reference to FIGS. 28 to 32.

Figure 28:
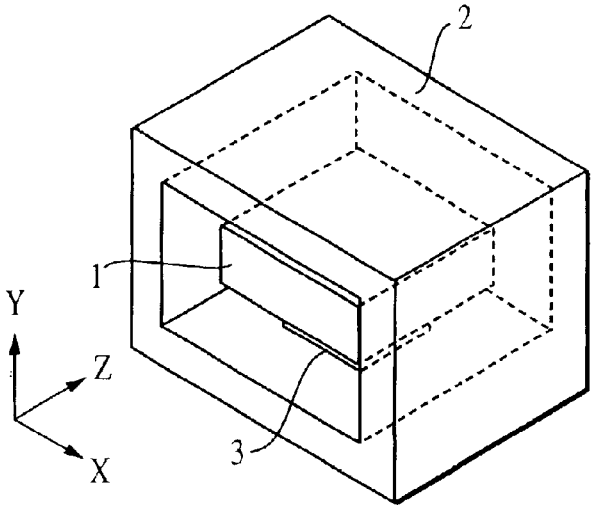
FIG. 28 is a perspective view showing the basic portion of a multimode dielectric resonator device according to an eighth embodiment.

FIG. 28 is a perspective view showing the basic constitution portion of a triplex mode dielectric resonator device. In this figure, reference numeral 1 designates a square plate-shaped dielectric core of which two sides have substantially equal lengths, and the other one side is shorter than each of the two sides. The reference numerals 2 and 3 designate an angular pipe-shaped cavity and a support for supporting a dielectric core 2 substantially in the center of the cavity 2, respectively. A conductor film is formed on the outer peripheral surface of the cavity 2. Dielectric sheets each having a conductor film formed thereon or metal sheets are disposed on the two open faces to constitute a substantially parallelepiped-shaped shield space. Further, an open-end of another cavity is opposed to an open-face of the cavity 2, so that electromagnetic fields in predetermined resonance modes are coupled to each other to realize a multi-stage.

The supports 3 shown in FIG. 28, made of a ceramic material having a lower dielectric constant than the dielectric core 1, are disposed between the dielectric core 1 and the inner walls of the cavity 2, respectively, and fired to be integrated.

Figure 29:
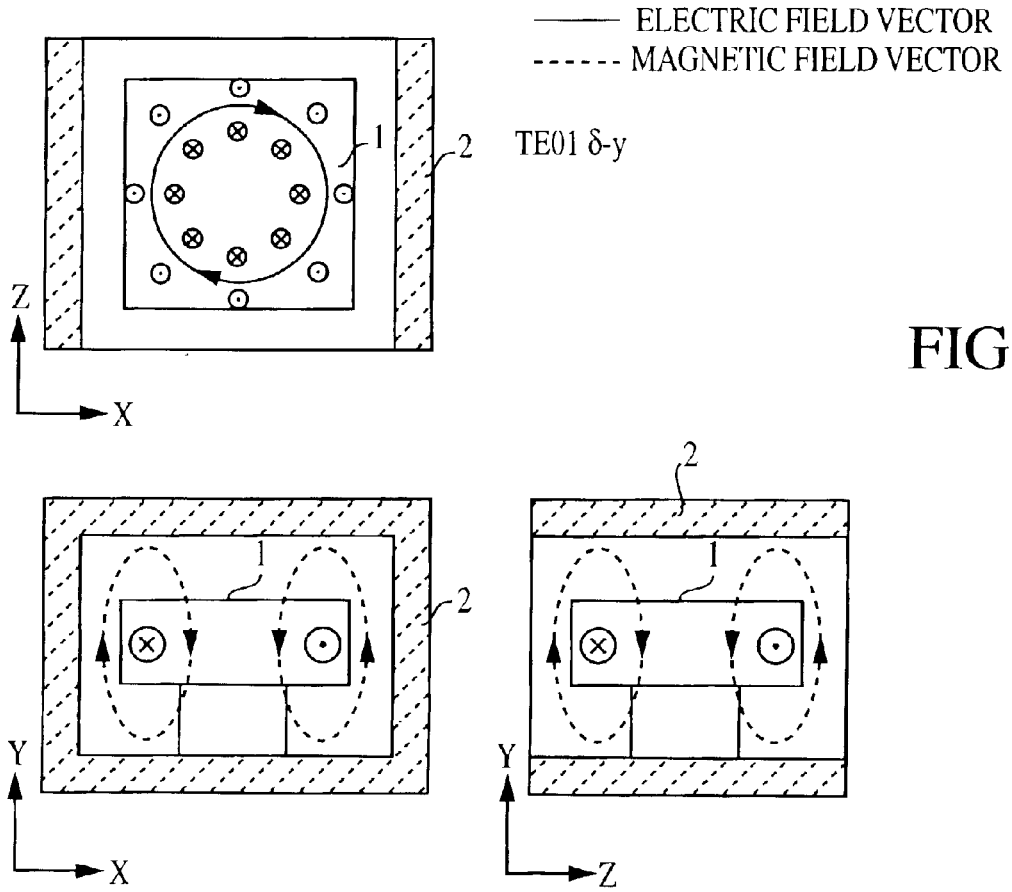
FIG. 29 consists of cross sections showing the electromagnetic field distributions of the respective modes in the above resonator device.
Figure 30:
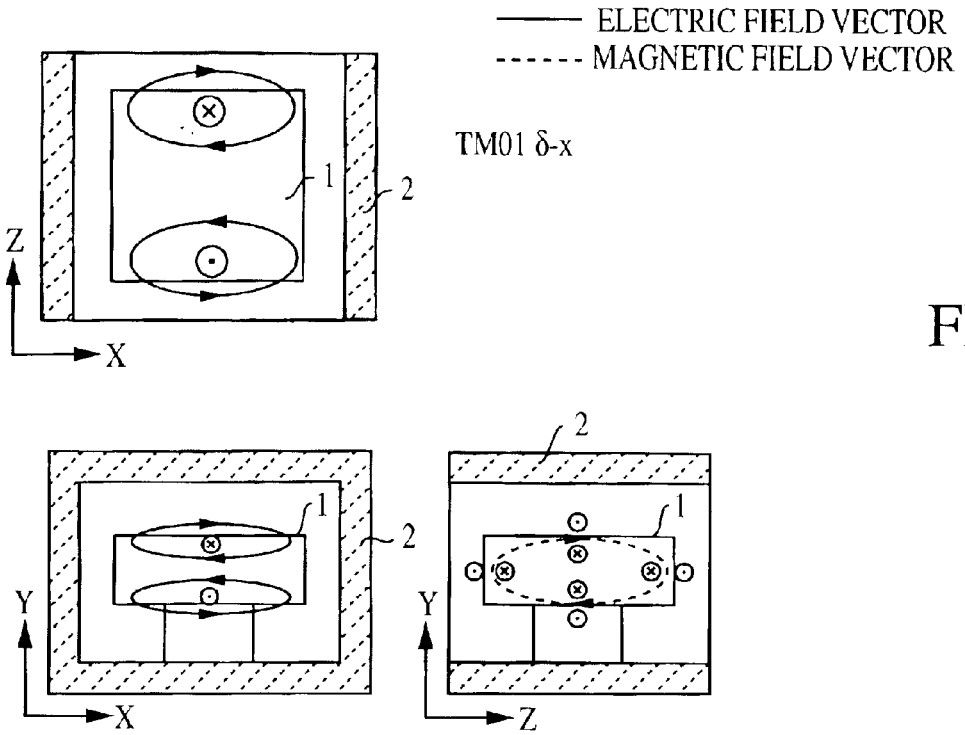
FIG. 30 consists of cross sections showing the electromagnetic field distributions of the respective modes in the above resonator device.
Figure 31:
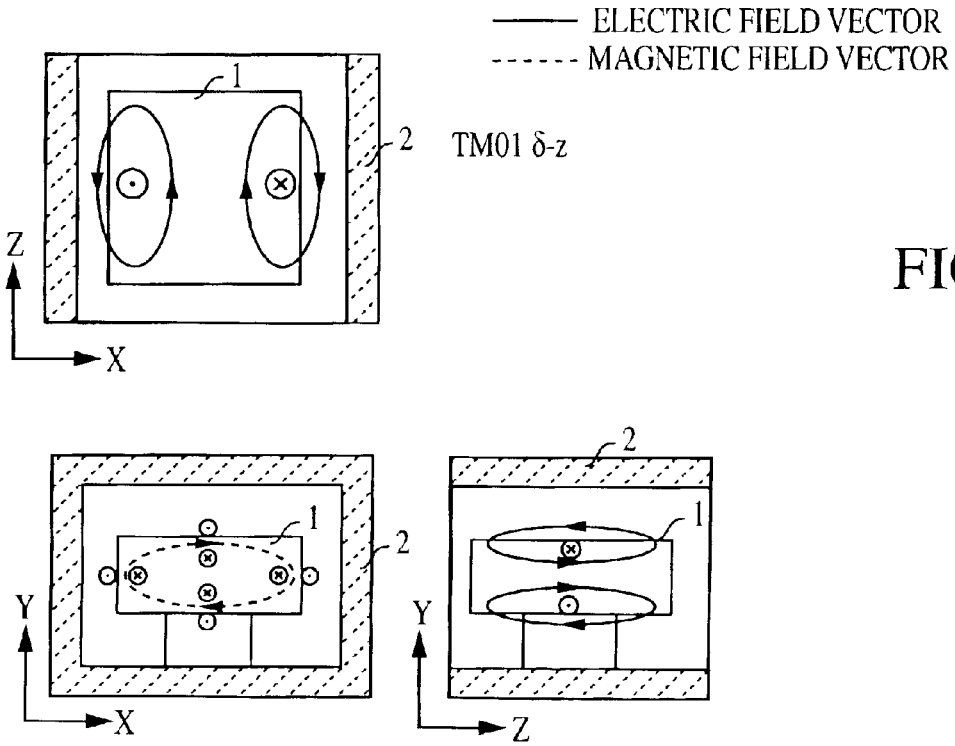
FIG. 31 consists of cross sections showing the electromagnetic wave distributions of the respective modes in the above resonator device.

FIGS. 29 to 31 show the resonance modes caused by the dielectric core 1 shown in FIG. 28. In these figures, x, y, and z represent the co-ordinate axes in the three dimensional directions shown in FIG. 28. FIGS. 29 to 31 show the cross sectional views taken through the two-dimensional planes, respectively. In FIGS. 29 to 31, a continuous line arrow designates an electric field vector, a broken line arrow does a magnetic field vector, and symbols "·" and "×" do the directions of the electric field and the magnetic field, respectively. In FIGS. 29 to 31, shown are the TE01δ mode (TE01δ-y mode) in the y–direction, the TM01δ mode (TM01δ-x) in the x-direction, and the TM01δ mode (TM01δ-z) in the z-direction.

Figure 32A:
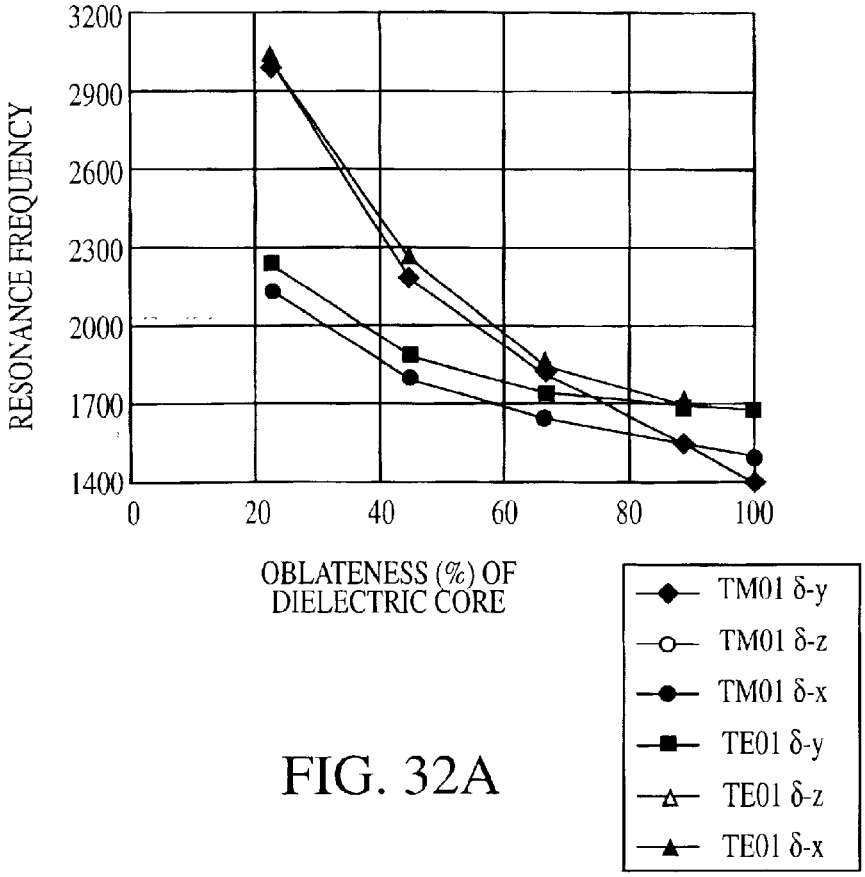
FIGS. 32(A,B) consists of graphs showing the relations between the thickness of the dielectric core of the above resonator device and the resonance frequencies of the respective modes.
Figure 32B:
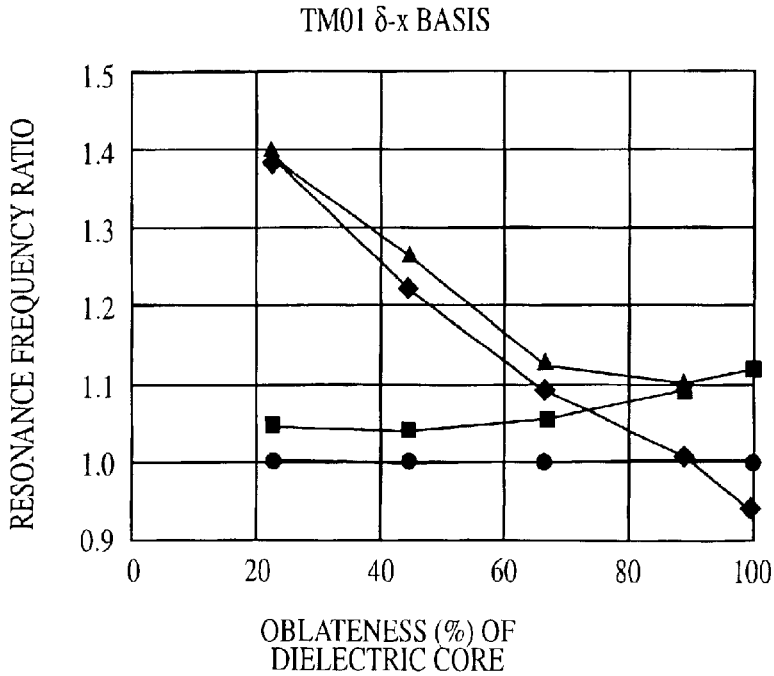

FIG. 32 shows the relations between the thickness of the dielectric core and the resonance frequencies of the six modes. In (A), the resonance frequency is plotted as ordinate. In (B), the resonance frequency ratio based on the TM01δ-x mode is plotted as ordinate. In (A) and (B), the thickness of the dielectric core, expressed as oblateness, is plotted as abscissa. The TE01δ-z mode and the TE01δ-x mode are symmetric. White triangle marks representing the TE01δ-z mode and black triangle marks for the TE01δ-x mode overlap each other. Similarly, the TM01δ-z mode and the TM01δ-x mode are symmetric. White circle marks representing the TM01δ-z mode, and black circle marks for the TM01δ-x mode overlap each other.

Like this, as the thickness of the dielectric core is thinned (the oblateness is decreased), the resonance frequencies of the TE01δ-y mode, the TM01δ-x mode, and the TM01δ-z mode have a larger difference from those of the TM01δ-y mode, the TE01δ-x, and the TE01δ-z mode, respectively.

In this embodiment, the thickness of the dielectric core is set by utilization of the above-described relation, and the TE01δ-y, TM01δ-x, and TM01δ-z modes are used. The frequencies of the other modes, that is, the TM01δ-y, TE01δ-x, and TE01δ-z modes are set to be further separated from those of the above-described modes so as not to be affected by them, respectively.

Figure 33A:
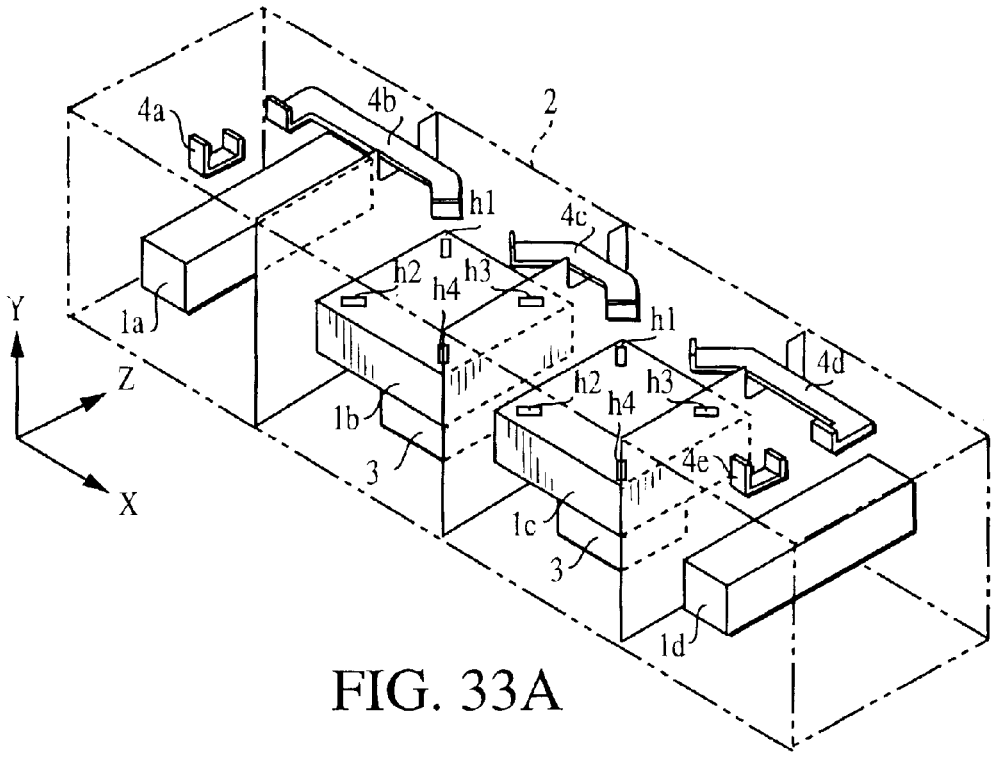
FIGS. 33(A,B,C) illustrates the configuration of a dielectric filter.
Figure 33B:
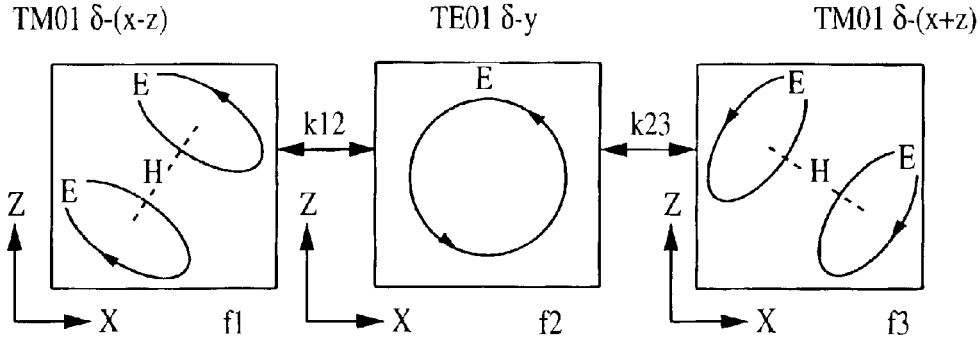
Figure 33C:
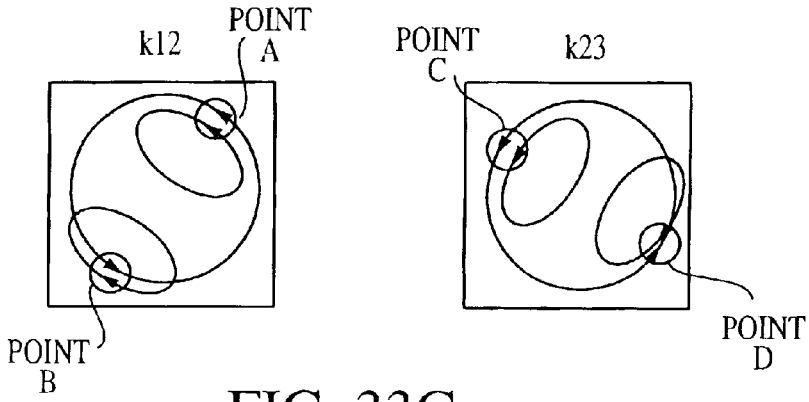

Next, an example of a dielectric filter including the above-described triplex mode dielectric resonator device will be described with reference to FIG. 33. In FIG. 33, reference numerals 1*a*, 1*d* designate prism-shaped dielectric cores, and are used as a TM single mode dielectric resonator. Reference numerals 1*b*, 1*c* designate square plate-shaped dielectric cores in which two sides have a substantially equal length, and the other one side is shorter than each of the two sides, respectively, and are used as the above triplex mode dielectric resonator. The triplex mode consists of three modes, that is, the TM01δ-(x–y) mode, the TE01δ-z mode, and the TM01δ-(x+y) mode, respectively, as shown in FIG. 15.

Reference numerals 4*a* to 4*e* each represent a coupling loop. One end of the coupling loop 4*a* is connected to a cavity 2, and the other end is connected to the core conductor of a coaxial connector (not illustrated), for example. The coupling loop 4*a* is arranged in the direction where a TM single mode magnetic field (magnetic force line) caused by the dielectric core 1*a* passes the loop plane of the coupling loop 4*a*, so that the coupling loop 4*a* is magnetic-field coupled to the TM single mode caused by the dielectric core 1*a*. The vicinity of one end of the coupling loop 4*b* is elongated in the direction where it is magnetic field coupled to the TM single mode of the magnetic core 1*a*, while the other end is elongated in the direction where it is magnetic-field coupled to the TM01δ-(x–y) mode of the dielectric core 1*b*. Both ends of the coupling loop 4*b* are connected to the cavity 2. The vicinity of one end of the coupling loop 4*b* is elongated in the direction where it is magnetic-field coupled to the TM single mode of the magnetic core 1*a*, while the other end thereof is elongated in the direction where it is magnetic field coupled to the TM01δ-(x–y) mode of the dielectric core 1*b*. Both ends of the coupling loop 4*b* are connected to the cavity 2. The vicinity of one end of the coupling loop 4*c* is elongated in the direction where it is magnetic-field coupled to the TM01δ-(x+y) mode of the magnetic core 1*a*, while the other end thereof is elongated in the direction where it is magnetic-field coupled to the TM01δ-(x–y) mode of the dielectric core 1*b*. Both ends of the coupling loop 4*c* are connected to the cavity 2. Further, one end of the coupling loop 4*d* is elongated in the direction where it is magnetic-field coupled to the TM01δ-(x+y) mode of the magnetic core 1*c*, while the other end thereof is elongated in the direction where it is magnetic-field coupled to the TM single mode of the dielectric core 1*d*. Both ends of the coupling loop 4*d* are connected to the cavity 2. The coupling loop 4*e* is arranged in the direction where it is magnetic-field coupled to the TM single mode of the magnetic core 1*d*. One end of the coupling loop 4*e* is connected to a cavity 2, while the other end is connected to the core conductor of a coaxial connector (not illustrated).

Coupling-conditioning holes h2 and h4 are formed in the triplex mode dielectric resonator caused by the dielectric core 1*b*, and the triplex mode dielectric resonator caused by the dielectric core 1*c*, respectively. As shown in FIG. 15, with the coupling conditioning hole h2, energy is transferred from the TM01δ-(x–z) mode to the TE01δ-y mode. With the coupling-conditioning hole h4, energy is transferred from the TE01δ-z mode to the TM01δ-(x+y) mode. Thereby, the dielectric cores 1*b*, 1*c* form resonator circuits in which three stage resonators are longitudinally connected, respectively, and operate as a dielectric filter comprising eight stage resonators (1+3+3+1) longitudinally connected to each other, as a whole.

Figure 34:
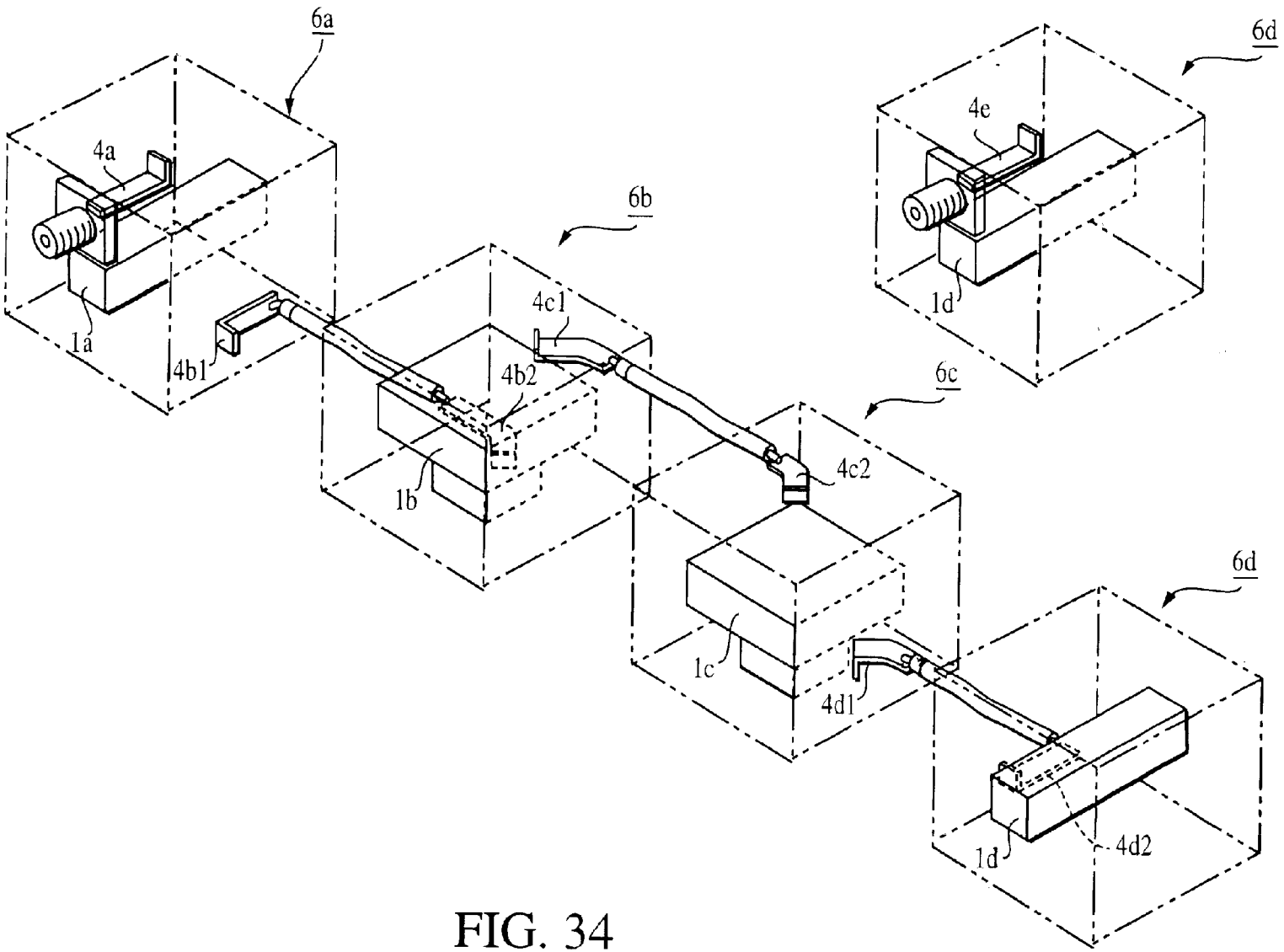
FIG. 34 illustrates the configuration of another dielectric filter.

Next, an example of another dielectric filter including the above-described triplex mode dielectric resonator device will be described with reference to FIG. 34. In the example shown in FIG. 33, the coupling loops, which are coupled to the respective resonance modes caused by adjacent dielectric cores, are provided. However, each dielectric resonator device may be provided for each dielectric core, independently. In FIG. 34, reference numerals 6*a*, 6*b*, 6*c*, and 6*d* designate dielectric resonator devices, respectively. These correspond to the resonators which are caused by the respective dielectric cores shown in FIG. 33 and are separated from each other. The dielectric resonator devices are positioned as distantly from each other as possible so that two coupling loops provided for the respective dielectric resonator devices are prevented from interfering with each other. Reference numerals 4*a*, 4*b*1, 4*b*2, 4*c*1, 4*c*2, 4*d*1, 4*d*2, and 4*e* designate respective coupling loops. One end of each of the coupling loops is grounded inside of the cavity, and the other end is connected to the core conductor of a coaxial cable by soldering or caulking. The outer conductor of the coaxial cable is connected to the cavity by soldering or the like. Regarding the dielectric resonator 6*d*, the figure showing the coupling loop d2 and the figure showing the coupling loop 4*e* are separately presented for simple illustration.

The coupling loops 4*a*, 4*b*1 are coupled to the dielectric core 1*a*, respectively. The coupling loop 4*b*2 is coupled to the TM01δ-(x−z) of the dielectric core 1*b*. The coupling loop 4*c*1 is coupled to the TM01δ-(x+z) of the dielectric core 1*b*. Similarly, the coupling loop 4*c*2 is coupled to the TM01δ-(x−z) of the dielectric core 1*c*. The coupling loop 4*d*1 is coupled to the TM01δ-(x+z) of the dielectric core 1*c*. The coupling loops 4*d*2 and 4*e* are coupled to the dielectric core 1*d*, respectively.

Accordingly, the coupling loops 4*b*1 and 4*b*2 are connected through a coaxial cable, the coupling loops 4*c*1 and 4*c*2 are connected through a coaxial cable, and further the coupling loops 4*d*1 and 4*d*2 are connected through a coaxial cable, and thereby, the device operates as a dielectric filter comprising the resonators in eight stages (1+3+3+1) longitudinally connected to each other, as a whole, similarly to that shown in FIG. 34.

Figure 35:
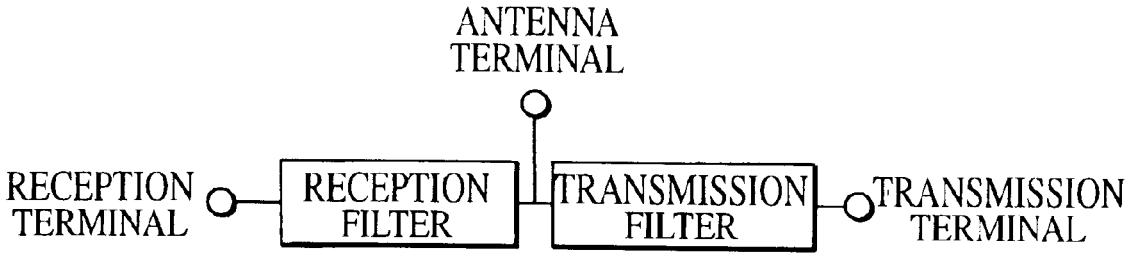
FIG. 35 illustrates the configuration of a transmission-reception shearing device.

Next, an example of the configuration of a transmission—reception shearing device will be shown in FIG. 35. Hereupon, a transmission filter and a reception filter are band-pass filters each comprising the above dielectric filter. The transmission filter passes the frequency of a transmission signal, and the reception filter passes the frequency of a reception signal. The connection position at which the output port of the transmission filter and the input port of the reception filter are connected is such that it has the relation that the electrical length between the connection point and the equivalent short-circuit plane of the resonator in the final stage of the transmission filter is odd-number times of the ¼ wave length of the wave with a reception signal frequency, and the electrical length between the above-described connection point and the equivalent short-circuit plane of the resonator in the first stage of the reception filter of the reception filter is odd-number times of the ¼ wavelength of a wave with a transmission signal frequency. Thereby, the transmission signal and the reception signal can be securely branched.

As seen in the above-description, similarly, by disposing plural dielectric filters between a port for use in common and individual ports, a diplexer or a multiplexer can be formed.

Figure 36:
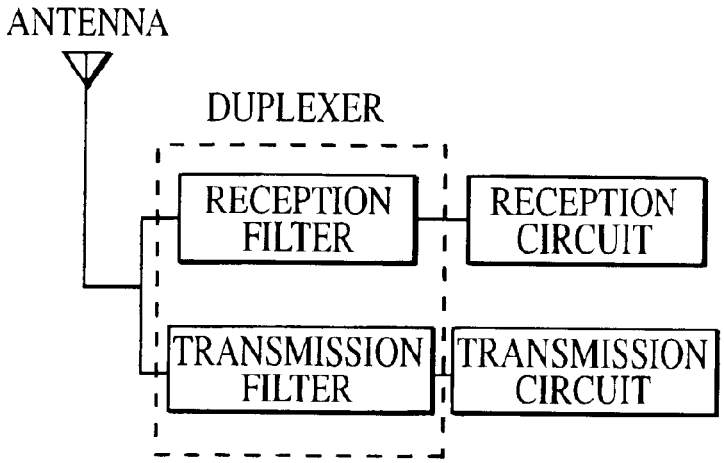
FIG. 36 illustrates the configuration of a communication device.

FIG. 36 is a block diagram showing the configuration of a communication device including the above-described transmission—reception shearing device (duplexer). The high frequency section of the communication device is formed by connecting a transmission circuit to the input port of a transmission filter, connecting a reception circuit to the output port of a reception filter, and connecting an antenna to the input-output port of the duplexer.

Further, a communication device small in size, having a high efficiency can be formed by use of circuit components such as the duplexer, the multiplexer, the synthesizer, the distributor each described above, and the like which are formed of the multimode dielectric resonator devices.

As seen in the above-description, according to the present invention defined in claims 1, 2, the dielectric core having a substantial parallelepiped-shape is disposed substantially in the center of the cavity having a substantial parallelepiped-shape. Therefore, the concentration degree of an electromagnetic field energy onto the dielectric core, though it is in a TM mode, is enhanced, a real electric current flowing through the cavity becomes fine, and the Qo can be enhanced. Moreover, though the dielectric core and the cavity are single, respectively, the miniaturization as a whole can be achieved.

According to the present invention defined in claims 3 and 4, the multiplexing, that is, duplexing or triplexing can be made, so that the miniaturization as a whole can be realized.

According to the preset invention defined in claim 5, a dielectric resonator device using both modes, namely, a TM mode and a TE mode can be obtained. The dielectric resonator device has a multimode, that is, a quadruplex mode or higher, so that further miniaturization as a whole can be realized.

When the above-described respective multiplexed resonance modes are used independently, not coupled to each other, for example, a circuit comprising plural resonators, such as a band-rejection filter, a synthesizer, a distributor, or the like, can be formed so as to be small in size by use of a single dielectric core.

According to the present invention defined in claim 6, a resonator device comprising plural dielectric resonators connected into a multistage is formed. A small-sized dielectric resonator device having a band-pass filter characteristic can be obtained. By use of a resonator in which some of the plural resonance modes are sequentially coupled, and the other resonance modes are uses as an independent resonator, respectively, a filter in which a band-pass filter and a band-rejection filter are combined can be formed.

According to the present invention defined in claim 7, a dielectric filter having a high Q filter characteristic and a small-size can be obtained.

According to the present invention defined in claim 8, a composite dielectric filter small in size, having a low loss can be obtained.

According to the present invention defined in claim 9, a synthesizer small in size, having a low loss can be obtained.

According to the present invention defined in claim 10, a distributor small in size, having a low loss can be obtained.

According to the present invention defined in claim 11, a communication device small in size, having a high efficiency can be obtained.

INDUSTRIAL APPLICABILITY

As seen in the above-description, the dielectric resonator device, the dielectric filter, the composite dielectric filter, the distributor, and the communication device including the same, according to the present invention, each of which operates in a multimode can be used in a wide variety of electronic apparatuses, for example, in the base stations of a mobile communication system.

What is claimed is:

1. A multimode resonator device comprising a single dielectric core having a substantial parallelepiped-shape and a supporting member having a lower dielectric constant than said dielectric core and which supports said dielectric core substantially in the center of a cavity having a substantial parallelepiped-shape, which produces a TM01δ-x mode, a TM01δ-y mode, a TE01δ-x mode and a TE01δ-y mode, and predetermined modes of the TM01δ-x mode, the TM01δ-y mode, the TE01δ-x mode and the TE01δ-y mode are coupled to each other by disturbing a symmetry of the dielectric core.

2. A multimode dielectric resonator device according to claim 1, wherein said device further produces a TM01δ-z mode, and predetermined modes of the TM01δ-x mode, the TM01δ-y mode, the TM01δ-z mode, the TE01δ-x mode and the TE01δ-y mode are coupled to each other by disturbing the symmetry of the dielectric core.

3. A multimode dielectric resonator device according to claim 2, wherein said device further produces a TE01δ-z mode, and predetermined modes of the TM01δ-x mode, the TM01δ-y mode, the TM01δ-z mode, the TE01δ-x mode, the TE01δ-y mode and the TE01δ-z mode are coupled to each other by disturbing the symmetry of the dielectric core.

4. A multimode dielectric resonator device according to claim 1, wherein said device further produces a TE01δ-z mode, and predetermined modes of the TM01δ-x mode, the TM01δ-y mode, the TE01δ-x mode, the TE01δ-y mode and the TE01δ-z mode are coupled to each other by disturbing the symmetry of the dielectric core.

* * * * *